US011540684B2

(12) United States Patent
Xing et al.

(10) Patent No.: US 11,540,684 B2
(45) Date of Patent: Jan. 3, 2023

(54) ROLLING BRUSH ASSEMBLY AND DUST COLLECTOR WITH THE SAME

(71) Applicant: Skybest Electric Appliance (Suzhou) Co., Ltd., Suzhou (CN)

(72) Inventors: Zhenyu Xing, Suzhou (CN); Dezhi Gu, Suzhou (CN); Yewei Xue, Suzhou (CN)

(73) Assignee: SKYBEST ELECTRIC APPLIANCE (SUZHOU) CO., LTD., Suzhou (CN)

( * ) Notice: Subject to any disclaimer, the term of this patent is extended or adjusted under 35 U.S.C. 154(b) by 240 days.

(21) Appl. No.: 15/931,991

(22) Filed: May 14, 2020

(65) Prior Publication Data

US 2021/0068600 A1 Mar. 11, 2021

(30) Foreign Application Priority Data

| | | |
|---|---|---|
| Sep. 5, 2019 | (CN) | 201921471411.3 |
| Nov. 26, 2019 | (CN) | 201922060934.5 |
| Nov. 26, 2019 | (CN) | 201922061959.7 |

(51) Int. Cl.

| | |
|---|---|
| ***A47L 9/04*** | (2006.01) |
| ***A46B 13/00*** | (2006.01) |
| ***A46B 13/02*** | (2006.01) |
| ***A46B 9/00*** | (2006.01) |

(52) U.S. Cl.

CPC ..... *A47L 9/0411* (2013.01); *A46B 9/005* (2013.01); *A46B 13/001* (2013.01); *A46B 13/02* (2013.01); *A47L 9/0477* (2013.01); *A46B 2200/3033* (2013.01)

(58) Field of Classification Search

CPC .... A47L 9/0411; A47L 9/0477; A46B 13/001; A46B 9/005; A46B 13/02; A46B 2200/3033

See application file for complete search history.

(56) References Cited

U.S. PATENT DOCUMENTS

| | | | | |
|---|---|---|---|---|
| 9,351,618 | B2 | 5/2016 | Van Der Kooi et al. | |
| 2010/0306957 | A1* | 12/2010 | Follows | A46B 13/006 15/363 |
| 2019/0298126 | A1* | 10/2019 | Conrad | A47L 9/0494 |
| 2019/0307302 | A1* | 10/2019 | Zheng | A47L 9/0477 |
| 2020/0046183 | A1* | 2/2020 | Choi | A47L 7/0066 |
| 2021/0094077 | A1* | 4/2021 | Kane | A47L 9/0477 |

* cited by examiner

*Primary Examiner* — Andrew A Horton

(74) *Attorney, Agent, or Firm* — JK Intellectual Property Law, PA

(57) ABSTRACT

A rolling brush assembly includes a rolling brush having a rolling brush roller, at least two brush bars, and a protruding strip extending lengthwise along an axis. Each brush bar extends lengthwise in a longitudinal direction of the rolling brush roller. The brush bars are arranged at intervals along a circumferential direction of the rolling brush roller with the protruding strip located between adjacent two brush bars. The at least two brush bars are fixed on the rolling brush roller in one of a flocking or an inserting manner. An engagement portion is formed between the brush bars and the rolling brush roller. A distance from an outer end of the engagement portion to the axis is less than a distance from an outer end of the protruding strip to the axis.

8 Claims, 9 Drawing Sheets

ROLLING BRUSH ASSEMBLY AND DUST COLLECTOR WITH THE SAME

CROSS-REFERENCE TO RELATED PATENT APPLICATIONS

This application claims priority to CN Patent Application No. 201922060934.5, filed on Nov. 26, 2019 and CN Patent Application No. 201922061959.7, filed on Nov. 26, 2019 and CN Patent Application No. 201921471411.3, filed on Sep. 5, 2019. All of the aforementioned applications are hereby incorporated by reference in their entireties.

TECHNICAL FIELD

The present disclosure belongs to the technical field of clean electrical apparatus, especially relates to a rolling brush assembly and a dust collector with the same.

BACKGROUND

The dust collector (also known as a vacuum cleaner) is an electric cleaning appliance used for removing dust on floors, carpets, walls, furniture, clothes and various gaps. Generally, the dust collector mainly comprises a suction device and a suction pipeline, wherein the suction device mainly formed by a motor and a fan is arranged in the dust collector body, the suction pipeline comprises a suction head, a dust collection rigid pipe and a dust collection hose, the suction head is provided with a suction port with a downward opening and is communicated with an air inlet of the fan in the dust collector body through the dust collection rigid pipe and the dust collection hose.

The rolling brush of the existing dust collector is usually only provided with flocking, and in case of the flocking, when treating the surface to be cleaned, the hairs on the surface to be cleaned are very easily attached to the flocking and tightly wound on the roller body surface of the rolling brush along with the rotation of rolling brush, so that the rolling brush is difficult to clean, and the rolling brush is even caused to be entangled and unable to rotate normally.

SUMMARY

In order to solve the technical problem in the prior art that the hairs are easily wound on the rolling brush, the object of the present disclosure is to provide a rolling brush assembly to reduce hairs winding probability and provide a dust collector with this rolling brush assembly.

In order to achieve one of the above objects, an embodiment of the present disclosure provides a rolling brush assembly, including a rolling brush, which includes a rolling brush roller, at least two brush bars and a protruding strip extending lengthwise along an axis, each of the brush bars extends lengthwise in the longitudinal direction of the rolling brush roller, the at least two brush bars are arranged at intervals along the circumferential direction of the rolling brush roller, the protruding strip is located between adjacent two brush bars, wherein the brush bars are fixed on the rolling brush roller in an flocking or inserting manner, an engagement portion is formed between the brush bars and the rolling brush roller, and the distance from the outer end of the engagement portion to the axis is less than the distance from the outer end of the protruding strip to the axis.

As a further improvement of an embodiment of the present disclosure, the brush roller assembly further comprises a tooth mechanism including a supporting rod extending lengthwise parallel to the axis and a plurality of teeth extending from the supporting rod towards the rolling brush, the distance from the extending ends of the teeth to the axis being less than the distance from the outer end of the brush bar to the axis.

As a further improvement of an embodiment of the present disclosure, the distance from the extending ends of the teeth to the axis is greater than a distance from the outer end of the protruding strip to the axis.

As a further improvement of an embodiment of the present disclosure, the brush bar is provided as a bristle bar and includes bristles in the form of felt or pile, or the brush bar is provided as a flocking bundle group.

As a further improvement of an embodiment of the present disclosure, a part of the at least two brush bars is provided as a bristle bar and comprises bristles in the form of felt or pile, and another part of the at least two brush bars is provided as a flocking bundle group.

As a further improvement of an embodiment of the present disclosure, each of the brush bars and each of the protruding strips extend from one longitudinal end of the rolling brush roller to the other longitudinal end of the rolling brush roller;

Each of the brush bars includes two segments respectively extending in opposite spiral directions on the outer circumferential surface of the rolling brush roller, and each of the protruding strips includes two segments respectively extending in opposite spiral directions on the outer circumferential surface of the rolling brush roller; alternatively, each of the brush bars and each of the protruding strips extend in a single spiral direction about the axis.

In order to achieve one of the above objects of the present disclosure, an embodiment of the present disclosure further provides a dust collector which includes a machine body and a motor mounted on the machine body, and the dust collector further includes a rolling brush assembly, the rolling brush assembly includes a rolling brush which is mounted in the machine body and is driven by the motor to rotate about an axis, the rolling brush includes a rolling brush roller, brush bars and protruding strips extending lengthwise along the axis, the brush bars and the protruding strips extend lengthwise in the longitudinal direction of the rolling brush roller, wherein the brush bars are fixed on the rolling brush roller in a flocking or inserting manner, the brush bars and the rolling brush roller form an engagement portion therebetween, and the distance from the outer end of the engagement portion to the axis is less than the distance from the outer ends of the protruding strips to the axis.

As a further improvement of an embodiment of the present disclosure, the brush roller assembly further comprises a tooth mechanism including a supporting rod extending lengthwise parallel to the axis and a plurality of teeth extending from the supporting rod towards the brush roller, the distance from the extending ends of the teeth to the axis being less than the distance from the outer ends of the brush bars to the axis.

As a further improvement of an embodiment of the present disclosure, the distance from the extending ends of the teeth to the axis is greater than the distance from the outer ends of the protruding strips to the axis.

As a further improvement of an embodiment of the present disclosure, the brush bar is provided as a bristle bar and includes bristles in the form of felt or pile; or the brush bar is provided as a flocking bundle group.

In order to achieve one of the above objects of the present disclosure, an embodiment of the present disclosure further provides a rolling brush assembly, including a rolling brush and a tooth mechanism, wherein the rolling brush includes a rolling brush roller, at least two brush bars and a supporting bar extending lengthwise along an axis, each of the brush bars extends lengthwise in the longitudinal direction of the rolling brush roller, the at least two brush bars are arranged at intervals along the circumferential direction of the rolling brush roller, the supporting bar is located between the two adjacent brush bars, the supporting bars are provided as soft rubber bars, the brush bars are provided as bristle bars and t include bristles in the form of felt or pile, the tooth mechanism includes a supporting rod extending lengthwise parallel to the axis and a plurality of teeth extending from the supporting rod towards the rolling brush, and the distance from the extending ends of the teeth to the axis is less than the distance from the outer end of the supporting bar to the axis.

As a further refinement, the distance from the extending ends of the teeth to the axis is also less than the distance from the outer end of the brush bar to the axis.

As a further improvement, the distance from the outer end of the brush bar to the axis is less than the distance from the outer end of the supporting bar to the axis;

alternatively, the distance from the outer end of the brush bar to the axis is greater than the distance from the outer end of the supporting bar to the axis.

As a further improvement, the supporting bars are integrally provided on the circumferential surface of the rolling brush roller in a protruding mode.

In order to achieve one of the above purposes, one embodiment of the present disclosure further provides a rolling brush assembly, including a rolling brush and a tooth mechanism, wherein the rolling brush comprises a rolling brush roller, at least two brush bars and a supporting bar extending lengthwise along an axis, each of the brush bars extends lengthwise in the longitudinal direction of the rolling brush roller, the at least two brush bars are arranged at intervals along the circumferential direction of the rolling brush roll, the supporting bar is positioned between the two adjacent brush bars, the supporting bar is provided as a soft rubber bar, a part of the at least two brush bars is provided as a bristle bar and comprises bristles in the form of felt or pile, the other part of the at least two brush bars is provided as a flocking bundle group, the tooth mechanism comprises a supporting rod extending lengthways parallel to the axis and a plurality of teeth extending from the supporting rod to approach the rolling brush, and the distance from the extending ends of the teeth to the axis is less than the distance from the outer end of the supporting bar to the axis.

As a further refinement, the distance from the extending ends of the teeth to the axis is also less than the distance from the outer end of the brush bar to the axis.

As a further improvement, the distance from the outer end of the brush bar to the axis is less than the distance from the outer end of the supporting bar to the axis;

alternatively, the distance from the outer end of the brush bar to the axis is greater than the distance from the outer end of the supporting bar to the axis.

As a further improvement, the number of the flocking bundle groups is set to be at least two, between any two adjacent flocking bundle groups is provided with the supporting bar, and between any supporting bar and any flocking bundle group adjacent to the supporting bar is provided with the bristle bar.

As a further improvement, the supporting bars are integrally provided on the circumferential surface of the rolling brush roller in a protruding mode.

In order to achieve one of the above objects of the present disclosure, an embodiment of the present disclosure further provides a rolling brush assembly, including a rolling brush and a tooth mechanism, wherein the rolling brush includes a rolling brush roller, a brush bar and a supporting bar extending lengthwise along an axis, the brush bar and the supporting bar respectively extend lengthwise in the longitudinal direction of the rolling brush roller, the brush bar is provided as a bristle bar and includes bristles in the form of felt or pile, the supporting bar is provided as a soft rubber bar, the tooth mechanism includes a supporting rod extending lengthwise parallel to the axis and a plurality of teeth extending from the supporting rod towards the rolling brush, and the distance from the extending ends of the teeth to the axis is less than the distance from the outer end of the supporting bar to the axis.

In order to achieve one of the objects of the present disclosure, an embodiment of the present disclosure further provides a dust collector, including a machine body and a motor mounted on the machine body, wherein the dust collector further includes the rolling brush assembly, and the rolling brush is mounted on the machine body and is driven by the motor to rotate about the axis.

Compared with the prior art, the beneficial effects of the present disclosure reside in that: the supporting bars are provided on the circumferential surface of the rolling brush roller and can support the filaments in the radial direction of the rolling brush roller, so as to facilitate the filaments to be separated from the rolling brush, thereby avoiding the rolling brush being entangled because the filaments are tightly wound on the rolling brush roller, and ensuring the surface clean and the normal rotation of the rolling brush; moreover, the teeth are provided to be in contact with the supporting bars, so that the teeth can break the filaments on the supporting bars, thereby further improving the effect of preventing the filaments from being wound on the rolling brush; the protruding strips are provided on the outer circumferential surface of the rolling brush roller and can support the filaments in the radial direction of the rolling brush roller, so as to facilitate the filaments to be separated from the rolling brush, thereby avoiding the rolling brush being entangled because the filaments are tightly wound on the rolling brush roller, and ensuring the surface clean and the normal rotation of the rolling brush.

DETAILED DESCRIPTION

Figure 1:
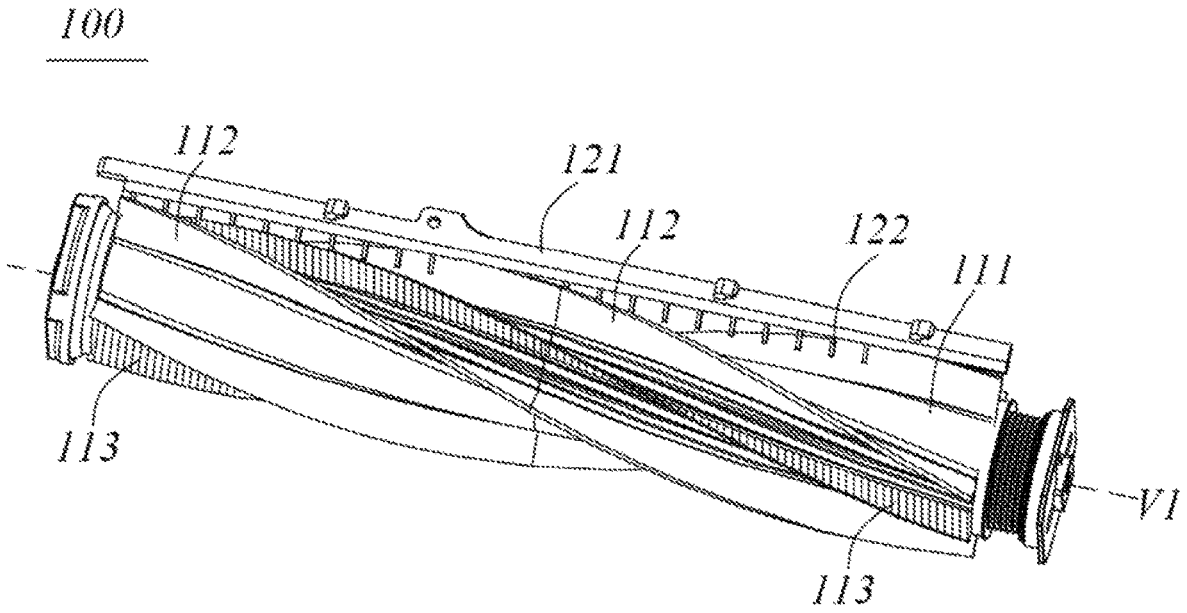
FIG. 1 is a schematic isometric view of a rolling brush assembly according to Embodiment 1 of the present disclosure.

The present disclosure will be described in detail below with reference to specific embodiments shown in the accompanying drawings. However, these embodiments do not limit the present disclosure, and structural, method, or functional changes that can be made by those skilled in the art according to these embodiments are all included in the scope of the present disclosure.

The present disclosure provides a rolling brush assembly and provides a dust collector with this rolling brush assembly. It should be noted that the dust collector of the present disclosure may be a robot dust collector, or other household or commercial dust collectors that use the rolling brush assembly, such as a vertical dust collector having a floor brush assembly.

Specifically, in the present embodiment, taking the rolling brush assembly used for a robot dust collector as an example, the robot dust collector includes a machine body, a motor mounted on the machine body, and the rolling brush assembly. The rolling brush assembly comprises a rolling brush and a tooth mechanism matched with the rolling brush, the rolling brush is mounted on the bottom of the machine body and driven to rotate by a motor, and the tooth mechanism is fixedly assembled on the machine body. When the robot dust collector works, the rolling brush is driven by the motor to rotate, so that the surface to be cleaned is cleaned/beaten. It should be noted that, in other embodiments, the rolling brush assembly may also be used for a dust collector having a floor brush assembly, i.e.: the rolling brush assembly is arranged on the floor brush assembly of the dust collector, and related contents are not described again.

Next, referring to the drawings, various embodiments of the rolling brush assembly of the present disclosure will be described, such as Embodiments 1 to 6, and the rolling brush assembly in each of the following embodiments can be applied to the dust collector as described above.

Embodiment 1

Figure 2:
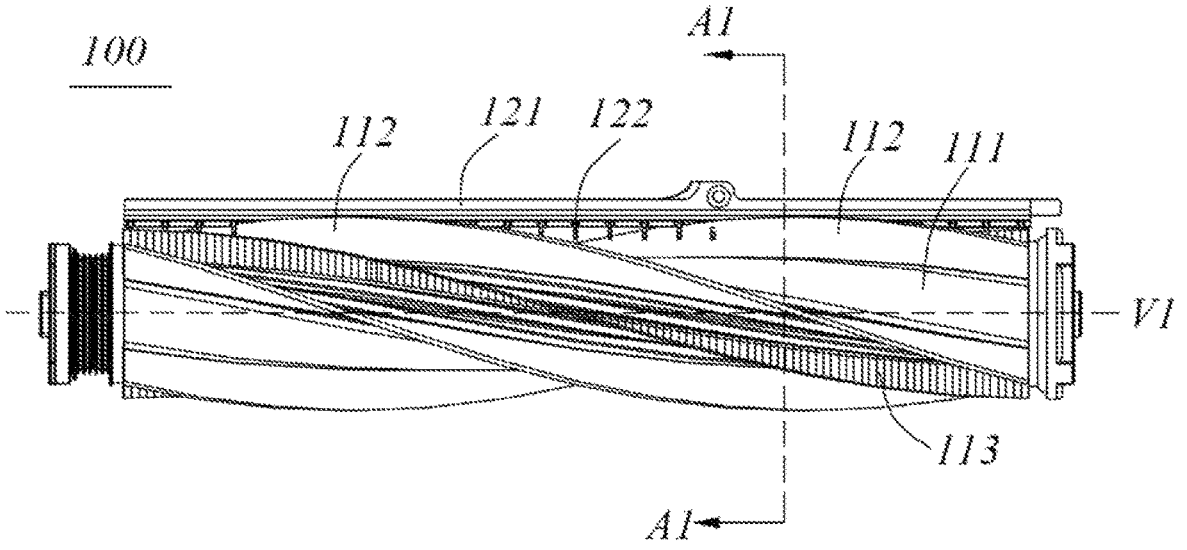
FIG. 2 is a front view of the rolling brush assembly according to Embodiment 1 of the present disclosure.
Figure 3:
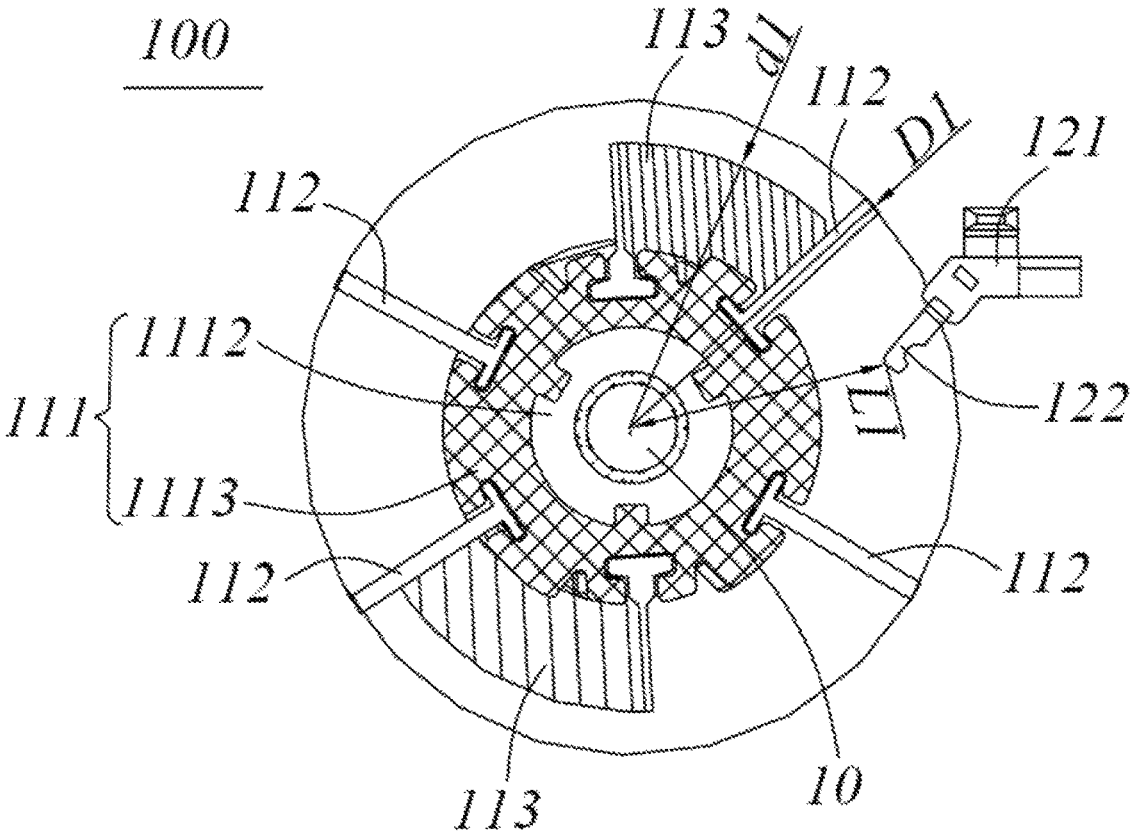
FIG. 3 is a cross-sectional view taken along line A1-A1 of FIG. 2.

Referring to FIGS. 1 to 3, a rolling brush assembly 100 according to Embodiment 1 of the present disclosure will be described. The rolling brush assembly 100 is arranged lengthwise and includes a rolling brush and a tooth mechanism matched with the rolling brush.

The rolling brush extends lengthwise along an axis V1, and includes a rolling brush roller 111, brush bars 113 mounted on the rolling brush roller 111, and supporting bars 112 mounted on the rolling brush roller 111.

The rolling brush roller 111 is substantially a longitudinal cylinder with the axis V1 as the central axis, is rotatably connected to the machine body, and is driven by the motor to rotate around the axis V1, thereby driving the rolling brush to rotate integrally.

Specifically, the rolling brush roller 111 specifically includes an inner roller 1112 sleeved outside the central rotating shaft 10 and an outer roller 1113 fixedly wrapped outside the inner roller 1112. The central rotating shaft 10 is connected with the driving shaft of the motor; the inner roller 1112 is generally configured as a rigid member, and is used for supporting the outer roller 1113 to avoid large bending deformation of the outer roller 1113 under the action of an external force, so as to ensure that the configuration of the rolling brush is stable; the outer circumferential surface of the outer roller 1113 constitutes the outer circumferential surface of the rolling brush roller 111, and the outer roller 1113 serves to fixedly support the brush bars 113 and the supporting bars 112.

The brush bars 113 are used for contacting the surface to be cleaned when the rolling brush is rotated, so as to sweep the surface to be cleaned, and the number of the brush bars is set to be at least two, and these brush bars 113 are arranged at uniform intervals along the circumferential direction of the rolling brush roller 111 (i.e., the circumferential direction of the axis V1). In the present embodiment, the number of the brush bars 113 is set to be two, and the two brush bars 113 are arranged oppositely along the circumferential direction of the rolling brush roller 111, and referring to FIG. 3, in the cross-section of the rolling brush assembly 100, the two brush bars 113 are symmetrically distributed at substantially 180° around the axis V1.

Furthermore, the bristles of the brush bars 113 may be any one or a combination of soft bristles and hard bristles in terms of hardness, may be any one or a combination of nylon 6, nylon 6/6, sponge, plant fiber, synthetic fiber, plastic, bristle and the like in terms of material, may be any one or a combination of a bundle, a piece of cloth, a line, a felt, a nap, a pile and the like in terms of density/shape, and may be any one or a combination of a flocking and a bristle bar in terms of load. In the present embodiment, the two brush bush bars 113 are provided identically, and are provided as bristle bars whose bristles are preferably in the form of felt, lines or piles, which are suitable for floor-type smooth surfaces to be cleaned.

In addition, the outer roller 1113 has a first groove recessedly provided in its outer circumferential surface, which is preferably configured as a T-groove, and extends along one longitudinal end of the rolling brush roller 111 to the other longitudinal end of the rolling brush roller 111. Correspondingly, the inner end of each brush bar 113 close to the axis V1 is configured to be shape-fitted with the first groove, and can be engaged in the first groove, so as to realize the detachable installation of the brush bar 113 on the rolling brush roller 111, for example, the brush bar 113 can be inserted into the first groove from one longitudinal end of the rolling brush roller 111, so as to realize the detachable installation of the brush bar 113. Of course, the shape of the first groove, the manner of mounting the brush bar 113, and the like are not limited thereto.

Furthermore, each brush bar 113 is provided as an elongated member extending in the longitudinal direction of the rolling brush roller 111, the longitudinal extension direction of which may be parallel to the axis V1 or may extend curvedly in a single spiral direction about the axis V1 as shown in the drawing, one longitudinal end of which is disposed at one longitudinal end of the outer roller 1113 and the other longitudinal end of which is disposed at the other longitudinal end of the outer roller 1113, that is, each brush bar 113 extends from one longitudinal end to the other longitudinal end of the outer roller 1113. Of course, in a modified embodiment, each brush bar 113 may also include two segments extending in opposite spiral directions on the outer circumferential surface of the rolling brush roller 111, that is, each brush bar 113 has a V-shape.

The supporting bars 112 are arranged between two adjacent brush bars 113. The supporting bars 112 may be soft rubber bars, especially plate-shaped soft rubber bars. In the present embodiment, the distance from the outer end of the brush bar 113 facing away from the rolling brush roller 111 to the axis V1 is d1, the distance from the outer end of the supporting bar 112 facing away from the rolling brush roller 111 to the axis V1 is D1, and the distance D1 is greater than the distance d1, i.e., the outer end of the supporting bar 112 is farther away from the axis V1 than the outer end of the brush bar 113. Then, when the rolling brush is applied to clean the surface to be cleaned, it is not only conducive to improving the cleaning effect, but also conducive to separating the hairs from the rolling brush under the supporting of the supporting bars 112, so as to avoid the hairs adhering to the brush bars 113 and are preferentially supported by the support bars 112, thereby avoiding the rolling brush being entangled because the hairs are tightly wound on the rolling brush roller 111, ensuring the surface clean and the normal rotation of the rolling brush.

Furthermore, between any two adjacent brush bars 113 is provided with a supporting bar 112, so that the supporting effect of the supporting bars 112 can be enhanced, the hairs are suspended above the brush bars 113 between the two supporting bars 112 due to the supporting of the two supporting bars 112, thereby reducing the contact probability of the hairs and the brush bars 113, avoiding the rolling brush being entangled because the hairs are tightly wound on the rolling brush roller 111, and ensuring the surface clean and the normal rotation of the rolling brush.

Preferably, between any two adjacent brush bars 113 is provided with two supporting bars 112, in the present embodiment, the number of the brush bars 113 is set to be two, and the number of the supporting bars 112 is set to be four.

In the present embodiment, the outer roller 1113 has a second groove recessedly provided in its outer circumferential surface, which is preferably configured as a T-groove, and extends along one longitudinal end of the rolling brush roller 111 to the other longitudinal end of the rolling brush roller 111. Correspondingly, the inner end of the supporting bar 112 close to the axis V1 is configured to be shape-fitted with the second groove, and can be clamped in the second groove, so that the supporting bar 112 can be detachably mounted on the rolling brush roller 111, for example, the supporting bar 112 can be inserted into the first groove from one longitudinal end of the rolling brush roller 111, so as to realize the detachable mount of the supporting bar 112. Of course, the shape of the second groove, the installation manner of the supporting bar 112, and the like are not limited thereto; in addition, in a modified embodiment, the supporting bar may be integrally formed to protrude on the outer circumferential surface of the rolling brush roller 111 (specifically, the outer circumferential surface of the outer roller 1113).

Furthermore, each supporting bar 112 is provided as a longitudinal member extending in the longitudinal direction of the rolling brush roller 111, the longitudinal extension direction of which may be parallel to the axis V1 or may extend curvedly in a single spiral direction about the axis V1 as shown in the drawing, and the longitudinal end of which is disposed at the longitudinal end of the outer roller 1113 and the other longitudinal end of which is disposed at the other longitudinal end of the outer roller 1113, that is, each supporting bar 112 extends from the longitudinal end to the other longitudinal end of the outer roller 1113. Of course, in a modified embodiment, each supporting bar 112 may also include two segments extending in opposite spiral directions on the outer circumferential surface of the rolling brush roller 111, that is, each supporting bar 112 has a V-shape.

Preferably, the supporting bar 112 and the brush bar 113 adjacent to the supporting bar 112 have longitudinal extension directions parallel to each other. That is, on the outer circumferential surface of the outer roller 1113, the first grooves and the second grooves adjacent to the first grooves have longitudinal extension directions parallel to each other.

The tooth mechanism extends lengthwise approximately parallel to the axis V1 and includes a supporting rod 121 and a plurality of teeth 122. Illustratively, the teeth 122 may be configured as comb teeth, and may also be configured as saw teeth. The supporting rod 121 can be fixedly assembled on the machine body, so that the whole gear mechanism is mounted on the machine body. These teeth 122 are arranged in sequence along the longitudinal direction of the tooth mechanism, each tooth 122 projecting beyond the supporting rod 121 and extending to approach the rolling brush, and the extending ends of the teeth 122 being spaced from the axis V1 by a distance L1. The distance L1 is less than the distance D1, that is, the extending ends of the teeth 122 can contact the supporting bars 112, so that the extending ends of the teeth 122 can contact the hairs on the supporting bars 112, thereby breaking the hairs attached to the supporting bars 112 to further facilitate the hairs to be separated from the rolling brush, and prevent the rolling brush from being entangled due to the hairs tightly entangled on the rolling brush roller 111.

Preferably, the distance L1 is further less than the distance d1, that is, the extending end of the teeth 122 can contact not only the supporting bars 112 but also the brush bars 113, so that if the hairs pass over the supporting bars 112 and contact the brush bars 113 due to rotation, the teeth 122 can scrape off or break the hairs attached to the brush bars 113 by contacting the brush bar 113, so as to further facilitate the hairs to be separated from the rolling brush, avoid the rolling brush from being entangled due to the hairs tightly wound on the rolling brush roller 111, and ensure the surface clean and the normal rotation of the rolling brush.

To sum up, compared with the prior art, the beneficial effect of the present embodiment is: under the supporting action of the supporting bars 112, the hairs are prevented from being attached to the brush bars 113 and are preferentially supported by the supporting bars 112, so as to facilitate the hairs to be separated from the rolling brush; the hairs attached to the supporting bars 112 are further broken by the extending ends of the teeth 122, so as to further facilitate the hairs to be separated from the rolling brush, so that the rolling brush is prevented from being entangled because the hairs are tightly wound on the rolling brush roller 111, and the surface clean and the normal rotation of the rolling brush are ensured.

Embodiment 2

Figure 4:
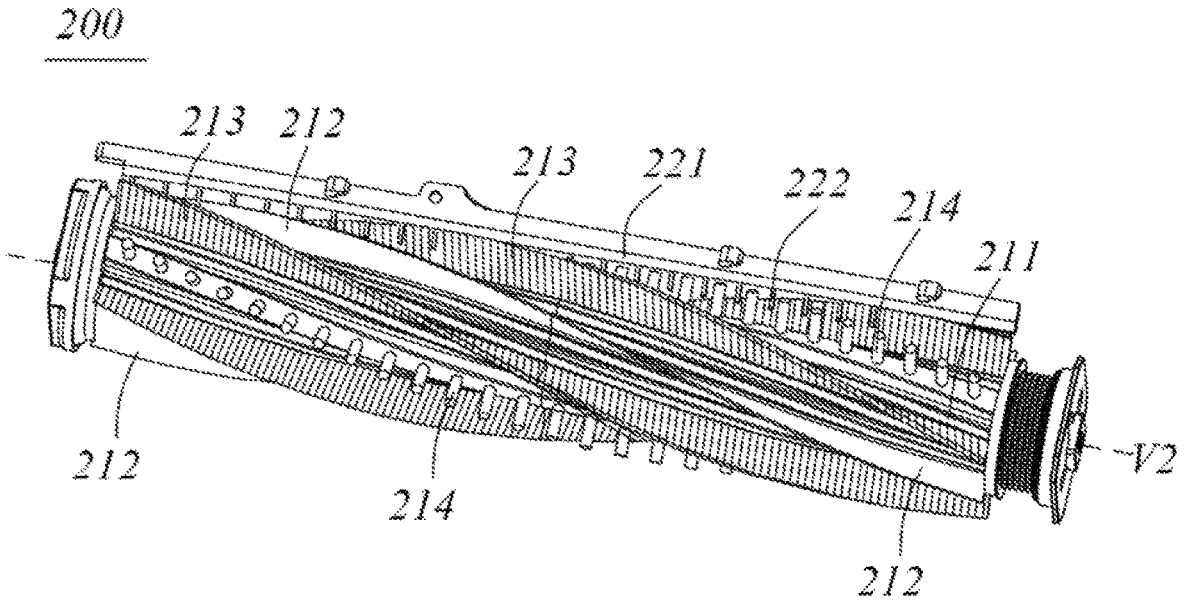
FIG. 4 is a schematic isometric view of a rolling brush assembly according to Embodiment 2 of the present disclosure.
Figure 5:
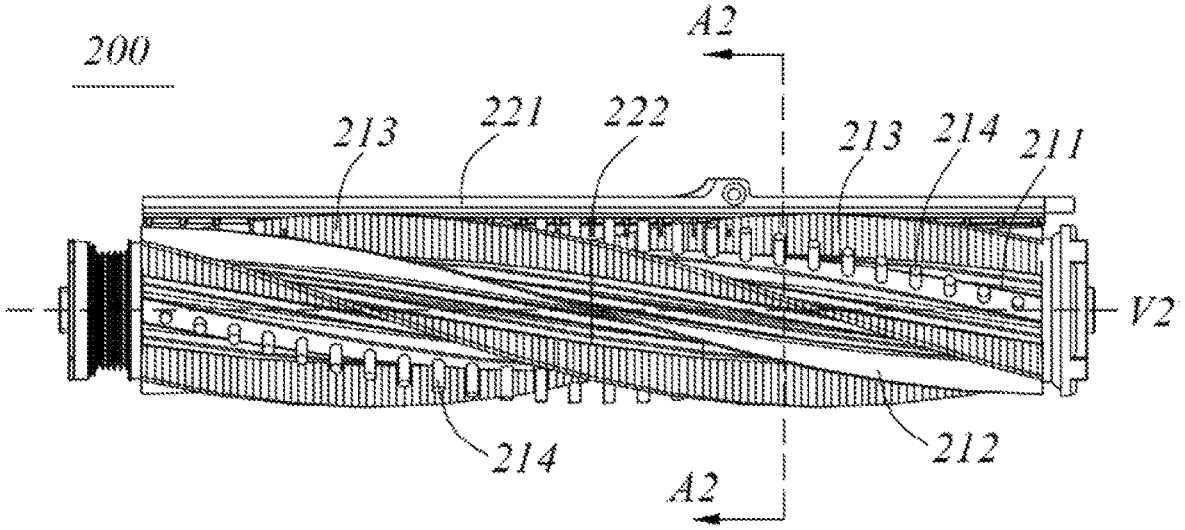
FIG. 5 is a front view of the rolling brush assembly according to Embodiment 2 of the present disclosure.
Figure 6:
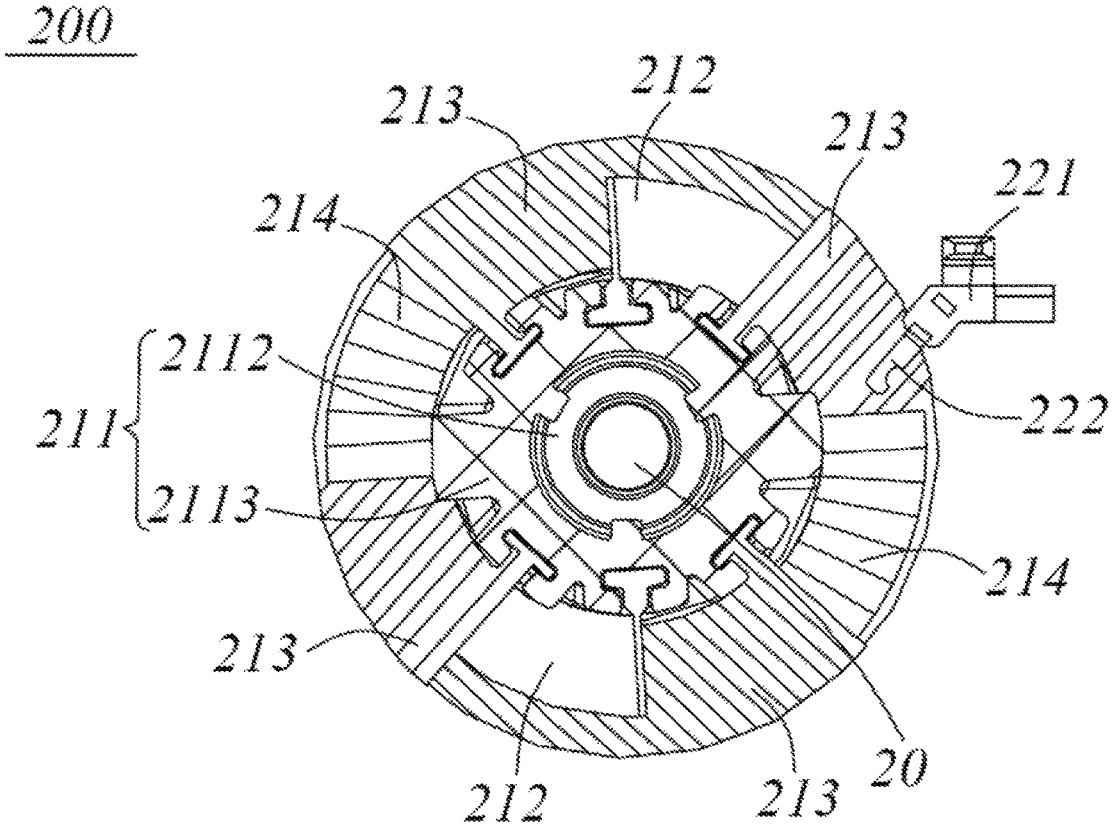
FIG. 6 is a cross-sectional view taken along line A2-A2 of FIG. 5.

Referring to FIGS. 4 to 6, a rolling brush assembly 200 according to Embodiment 2 of the present disclosure will be described. The rolling brush assembly 200 is arranged lengthwise and includes a rolling brush and a tooth mechanism matched with the rolling brush.

The rolling brush extends lengthwise along an axis V2 and includes a rolling brush roller 211, brush bars arranged on the rolling brush roller 211, and supporting bars 212 mounted on the rolling brush roller 211.

The rolling brush roller 211 is substantially a longitudinal cylinder with the axis V2 as the central axis, is rotatably connected to the machine body, and is driven by the motor to rotate around the axis V2, so as to drive the rolling brush to rotate integrally.

Specifically, the rolling brush roller 211 specifically includes an inner roller 2112 sleeved outside the central rotating shaft 20, and an outer roller 2113 fixedly wrapped outside the inner roller 2112. The central rotating shaft 20 is connected with the driving shaft of the motor; the inner roller 2112 is generally set as a rigid member, and is used for supporting the outer roller 2113 so as to avoid large bending deformation of the outer roller 2113 under the action of an external force, and ensure stable configuration of the rolling brush; the outer circumferential surface of the outer roller 2113 constitutes the outer circumferential surface of the rolling brush roller 211, and the outer roller 2113 is used to fixedly support the brush bars and the supporting bars 212.

The brush bars are used for contacting the surface to be cleaned when the rolling brush rotates to clean the surface to be cleaned, the number of the brush bars is set to be at least two, and these brush bars are arranged at intervals along the circumferential direction of the rolling brush roller 211 (i.e., the circumferential direction of the axis V2). Each of the brush bars extends lengthwise in the longitudinal direction of the rolling brush roller 211, and the longitudinal extension direction thereof may extend parallel to the axis V2, as shown in the drawing, along a single helical curve around the axis V2, and the longitudinal end thereof is disposed at the longitudinal end of the outer roller 2113, and the lengthwise other end thereof is disposed at the lengthwise other end of the outer roller 2113, that is, each of the brush bars extends from the longitudinal end to the lengthwise other end of the outer roller 2113. Of course, in a modified embodiment, each of the brush bars may also include two segments extending in opposite spiral directions on the outer circumferential surface of the rolling brush roller 111, that is, each of the brush bars has a V-shape.

Furthermore, a part of the at least two brush bars is configured as a flocking bundle group 214 flocked on the rolling brush roller 211, and the other part is configured as a brush bar 213 mounted on the rolling brush roller 211. Specifically, in the present embodiment, the number of the brush bars is set to be six, two of the brush bars are set to flocking bundle groups 214, and four of the brush bars are set to bristle bars 213, that is, the six brush bars include two flocking bundle groups 214 and four bristle bars 213, of course, in a modified embodiment, the number of the brush bars, the number of the flocking bundle groups 214, and the number of the bristle bars 213 are not limited thereto.

The flocking bundle groups 214 are used for contacting the surface to be cleaned when the rolling brush rotates so as to clean the surface to be cleaned, mainly for cleaning dust, and is more suitable for the surface to be cleaned of carpet. The flocking bundle groups 214 are formed by a plurality of tufts of flocking bundle. Each tuft of flocking bundle extends from the outer roller 2113 away from the axis V2, the plurality of tufts of flocking bundle are spaced apart in series along the flocking bundle groups 214 to form an elongated structure. Moreover, the two different tufts of flocking bundle can be set into straight bristles or curved bristles, or one of the two tufts of flocking is set into straight bristles and the other one is set into curved bristles. In addition, the flocking bundle may be made of synthetic fibers in terms of material, but is not limited thereto.

The two flocking bundle groups 214 are arranged opposite to each other in the circumferential direction of the rolling brush roller 211, and referring to FIG. 6, in the cross-section of the rolling brush assembly 200, the two flocking bundle groups 214 are arranged symmetrically at substantially 180° around the axis V2. Of course, in other embodiments, when the number of the flocking bundle groups 214 is set to three or more, these flocking bundle groups 214 are preferably arranged at uniform intervals in the circumferential direction of the rolling brush roller 211 (i.e., in the circumferential direction of the axis V2).

The bristle bars 213 are used for contacting the surface to be cleaned when the rolling brush rotates, so as to clean the surface to be cleaned, mainly for cleaning in a wiping manner, and are suitable for a floor type smooth surface to be cleaned. The bristles of the bristle bars 213 are preferably in the form of a felt or pile.

The four bristle bars 213 are uniformly spaced along the circumferential direction of the rolling brush roller 211 (i.e., the circumferential direction of the axis V2), and in the cross-section of the rolling brush assembly 100, the four bristle bars 213 are substantially spaced at 90° around the axis V2, as shown in FIG. 3.

In addition, the outer roller 2113 has a first groove recessedly provided in its outer circumferential surface, which is preferably configured as a T-groove, the first groove extending along one longitudinal end of the rolling brush roller 211 to the other longitudinal end of the rolling brush roller 211. Correspondingly, the inner end of the bristle bar 213 close to the axis V2 is configured to be shape-fitted with the first groove, and can be engaged in the first groove, so that the bristle bar 213 can be detachably mounted on the rolling brush roller 211, for example, the bristle bar 213 can be inserted into the first groove from one longitudinal end of the rolling brush roller 211, so as to realize the detachable mount of the bristle bar 213. Of course, the shape of the first groove, the installation manner of the bristle bar 213, and the like are not limited thereto.

The supporting bars 212 are arranged between two adjacent flocking bundle groups 214, and through providing the supporting bars 212, when the rolling brush is applied to the cleaning of the surface to be cleaned, the hairs are suspended due to the supporting of the two supporting bars 212, thereby facilitating the hairs to separate from the rolling brush, avoiding the rolling brush being entangled because the hairs are tightly wound on the rolling brush roller 211, and ensuring the surface clean and the normal rotation of the rolling brush.

Preferably, between any two adjacent flocking bundle groups 214 is provided with a supporting bar 212, and these supporting bars 212 are uniformly spaced along the circumferential direction (i.e., the circumferential direction of the axis V2) of the rolling brush roller 211. In the present embodiment, the number of the flocking bundle groups 214 is set to be two, the number of the supporting bars 212 is set to be two, and the two supporting bars 212 are oppositely arranged in the circumferential direction of the rolling brush roller 211, and referring to FIG. 6, in the cross-section of the rolling brush assembly 200, the two supporting bars 212 are symmetrically distributed at an angle of approximately 180° around the axis V2.

Each supporting bar 212 extends lengthwise in the longitudinal direction of the rolling brush roller 211, the longitudinal extension direction of which may be parallel to the axis V2 or may extend curvedly in a single spiral direction about the axis V2 as shown in the drawing, one longitudinal end of which is disposed at one longitudinal end of the outer roller 2113 and the other longitudinal end of which is disposed at the other longitudinal end of the outer roller 2113, that is, each supporting bar 212 extends from one longitudinal end to the other longitudinal end of the outer roller 2113. Of course, in a modified embodiment, each supporting bar 212 may also include two segments extending in opposite spiral directions on the outer circumferential surface of the rolling brush roller 111, that is, each supporting bar 212 has a V-shape.

The outer roller 2113 has a second groove recessedly provided in its outer circumferential surface, which is preferably configured as a T-groove, and extends along one longitudinal end of the rolling brush roller 211 to the other longitudinal end of the rolling brush roller 211. Correspondingly, the inner end of the supporting bar 212 close to the axis V2 is configured to be shape-fitted with the second groove, and can be clamped in the second groove, so that the supporting bar 212 can be detachably mounted on the rolling brush roller 211, for example, the supporting bar 212 can be inserted into the first groove from one longitudinal end of the rolling brush roller 211, so as to realize the detachable mount of the supporting bar 212. Of course, the shape of the second groove, the installation manner of the supporting bar 212, and the like are not limited thereto; in addition, in a modified embodiment, the supporting bar 212 may be integrally formed to protrude on the outer circumferential surface of the rolling brush roller 211 (specifically, the outer circumferential surface of the outer roller 2113).

Furthermore, the arrangement relationship of the supporting bars 212, the bristle bars 213 and the flocking bundle groups 214 is set as follows: between any supporting bar 212 and any flocking group 214 adjacent to the supporting bar is provided one bristle bar 213; in addition, the longitudinal extension directions of the supporting bars 212, the bristle bars 213 and the flocking bundle group 214 are parallel.

The tooth mechanism extends lengthwise approximately parallel to the axis V2 and includes a supporting rod 221 and a plurality of teeth 222, wherein the supporting rod 221 may be fixedly assembled to the machine body, so that the entire gear mechanism is mounted on the machine body. These teeth 122 are arranged in sequence along the longitudinal direction of the tooth mechanism, each tooth 122 projects beyond the supporting rod 121 and extends to approach the rolling brush, and the teeth 222 can at least contact with the supporting bars 212 of the supporting bars 212, the bristle bars 213 and the flocking bundle groups 214. In this way, the teeth 222 can contact the hairs on the supporting bars 212, so as to break the hairs attached to the supporting bars 212, thereby further facilitating the hairs to be separated from the rolling brush, avoiding the rolling brush from being entangled because the hair are tightly wound on the rolling brush roller 211, and ensuring the surface clean and the normal rotation of the rolling brush.

Specifically, there is a first distance from the outer ends of the bristle bars 213 facing away from the rolling brush roller 211 to the axis V2, there is a second distance from the outer ends of the supporting bars 212 facing away from the rolling brush roller 211 to the axis V2, there is a third distance from the outer ends of the flocking bundle groups 214 facing away from the rolling brush roller 211 to the axis V2, and there is a fourth distance from the extending ends of the teeth 222 to the axis V2, wherein the fourth distance is less than the second distance. In this way, it is ensured that the teeth 222 can contact the supporting bars 212 when the rolling brush is applied to the cleaning of the surface to be cleaned, so as to break the hairs attached to the supporting bars 212.

In the present embodiment, the fourth distance, the second distance, the third distance and the first distance are sequentially increased, that is, the extending ends of the teeth 222, the outer ends of the supporting bars 212, the outer ends of the flocking bundle groups 214 and the outer ends of the brush bars 213 are sequentially away from the axis V2. In this way, the extending ends of the teeth 222 can contact not only the supporting bars 212 but also the bristle bars 213 furthermore, so as to scrape off or break the hairs attached to the bristle bars 213, thereby further facilitating the hairs to be separated from the rolling brush.

In addition, each tooth 222 is positioned between adjacent two tufts of flocking bundle in the longitudinal direction of the brush roller assembly 200, that is, each tooth 222 passes between adjacent two tufts of flocking bundle, thereby pulling or breaking the hairs wound around the adjacent two tufts blocking bundle.

To sum up, compared with the prior art, the beneficial effect of the present embodiment is: under the supporting action of the supporting bars 212, the hairs are suspended due to the support of the two supporting bars 212, so as to facilitate the hairs to be separated from the rolling brush; the hairs attached to the supporting bars 212 are further broken by the extending ends of the teeth 222, so as to further facilitate the hairs to be separated from the rolling brush, so that the rolling brush is prevented from being entangled because the hairs are tightly wound on the rolling brush roller 111, and the surface clean and the normal rotation of the rolling brush are ensured.

Embodiment 3

Figure 7:
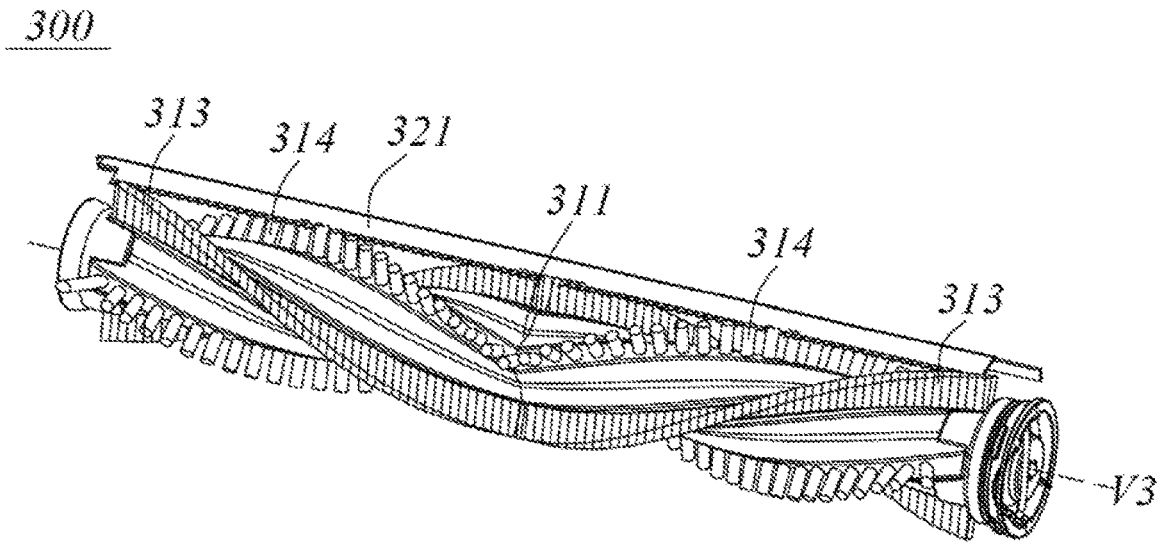
FIG. 7 is a schematic isometric view of a rolling brush assembly according to Embodiment 3 of the present disclosure.
Figure 8:
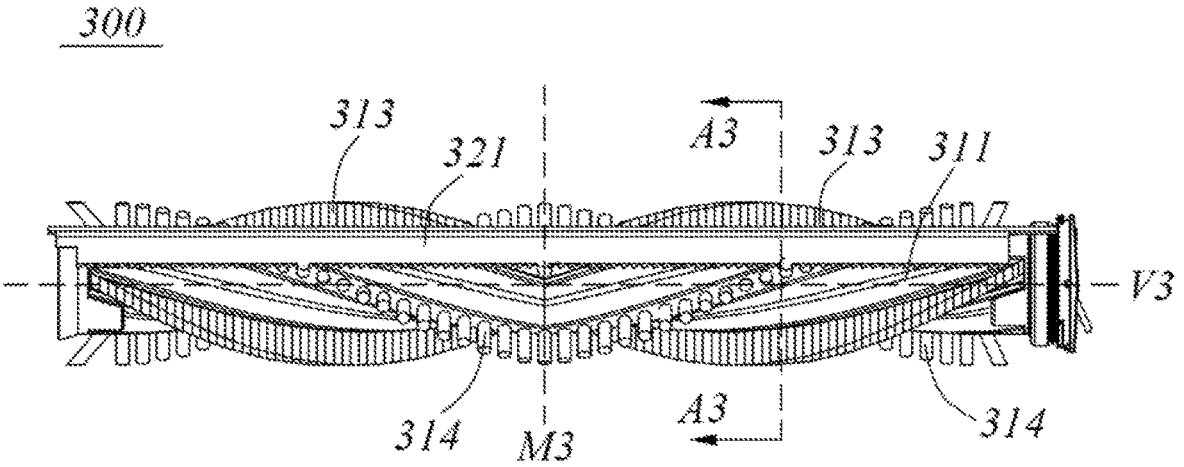
FIG. 8 is a front view of the rolling brush assembly according to Embodiment 3 of the present disclosure.
Figure 9:
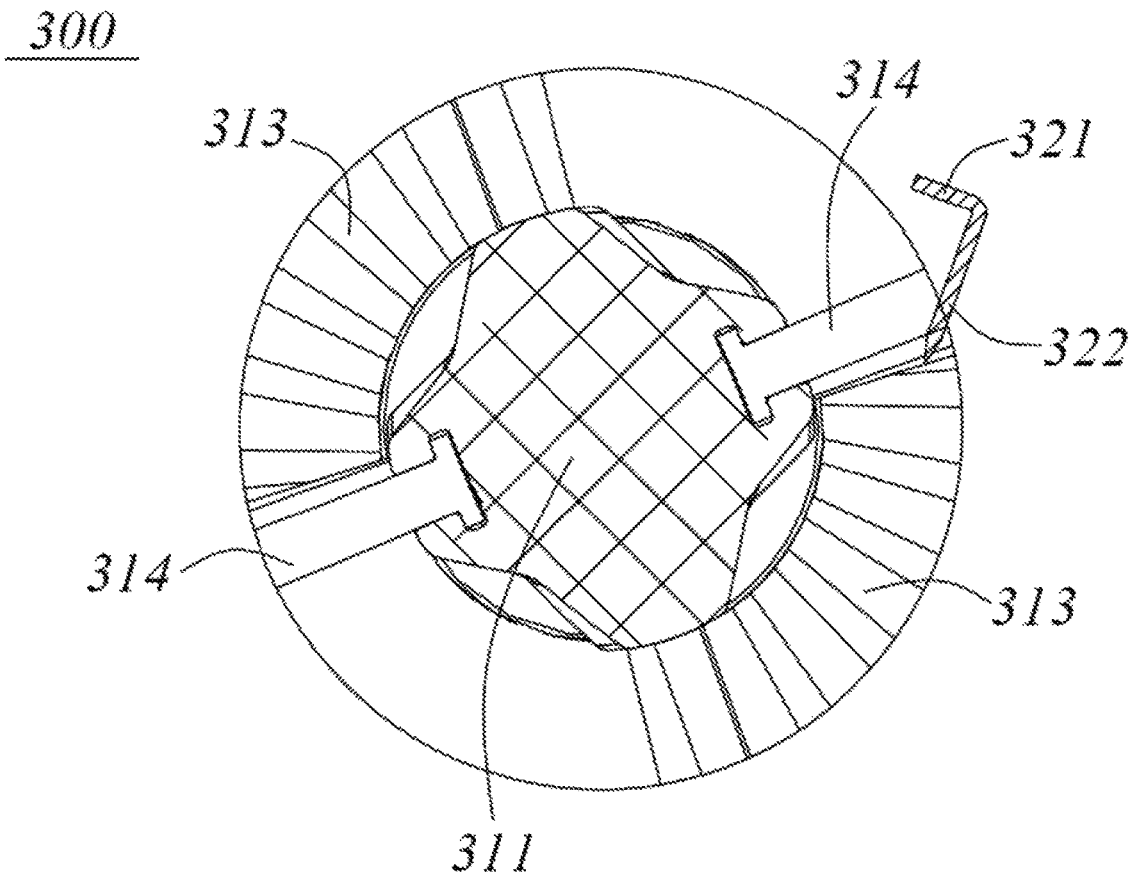
FIG. 9 is a cross-sectional view taken along line A3-A3 of FIG. 8.

Referring to FIGS. 7 to 9, a rolling brush assembly 300 according to Embodiment 3 of the present disclosure will be described. The rolling brush assembly 300 is arranged lengthwise and includes a rolling brush and a tooth mechanism matched with the rolling brush.

The rolling brush extends lengthwise along an axis V3 and comprises a rolling brush roller 311 and at least two brush bars mounted on the rolling brush roller 311.

The rolling brush roller 311 is substantially a longitudinal cylinder with the axis V3 as the central axis, is rotatably connected to the machine body, and is driven by the motor to rotate around the axis V3, so as to drive the rolling brush to rotate integrally. In the present embodiment, as shown in FIG. 8, preferably, the rolling brush roller 311 is formed by two equal length segments in the longitudinal direction thereof, and the two segments of the rolling brush roller 311 are arranged to be centrally symmetric with respect to the connecting plane M3. The rolling brush roller 311 is integrally formed, or the two segments of the rolling brush rollers 311 are independently formed, assembled and spliced.

The brush bars are used for contacting the surface to be cleaned when the rolling brush rotates to clean the surface to be cleaned, the number of the brush bars is set to be at least two, and these brush bars are arranged at intervals along the circumferential direction of the rolling brush roller 311 (i.e., the circumferential direction of the axis V3). Each of the brush bars is arranged lengthwise, the longitudinal extension direction of which may be parallel to the axis V3 or may extend curvedly as shown in the drawing, one longitudinal end of which is arranged at one longitudinal end of the rolling brush roller 311 and the other longitudinal end of which is arranged at the other longitudinal end of the rolling brush roller 311, i.e. the brush bars extend from one longitudinal end to the other longitudinal end of the rolling brush roller 311.

Preferably, in the present embodiment, as shown in FIG. 8, each of the brush bars includes a first segment extending in a first spiral direction and a second segment extending in a second spiral direction on the outer circumferential surface of the rolling brush roller 311, the first spiral direction and the second spiral direction being opposite; the first segment of the brush bar and the second segment of the brush bar intersect at the connecting plane M3, that is, each brush bar is distributed in a V shape on the outer circumference of the rolling brush roller 311. Further preferably, the first segment of the brush bar and the second segment of the brush bar are arranged to be centrally symmetric with respect to the connecting plane M3.

Furthermore, a part of the at least two brush bars is configured as a flocking bundle group 314 flocked on the rolling brush roller 311, and the other part is configured as a bristle bar 313 mounted on the rolling brush roller 311. Specifically, in the present embodiment, the number of the brush bars is set to be four, two of the brush bars are set to the flocking bundle group 314, and two of the brush bars are set to the bristle bar 313, that is, the four brush bars include two flocking bundle groups 314 and two bristle bars 313, and of course, in a modified embodiment, the number of the brush bars, the number of the flocking bundle groups 314, and the number of the bristle bars 313 are not limited thereto.

The flocking bundle groups 314 are used for contacting the surface to be cleaned when the rolling brush rotates, so as to clean the surface to be cleaned, mainly for cleaning dust, and is more suitable for the surface to be cleaned of carpet. The flocking bundle groups 314 are formed by a plurality of tufts of blocking bundle. Each tuft of blocking bundle extends from the rolling brush roller 311 away from the axis V3, and the plurality of tufts of blocking bundle are spaced apart in series along the blocking bundle groups 314 to form an elongated structure. Moreover, the two different tufts of blocking bundle bundles can both be set into straight bristles or curved bristles, or one of the two tufts of blocking bundle is set into straight bristles and the other is set into curved bristles. Preferably, in one flocking bundle group 314, a tuft of straight bristles and a tuft of curved bristles are arranged alternately. In addition, the flocking bundle may be made of synthetic fibers in terms of material, but is not limited thereto.

The two flocking bundle groups 314 are arranged opposite to each other in the circumferential direction of the rolling brush roller 311, and referring to FIG. 9, the two flocking bundle groups 314 are symmetrically arranged at substantially 180° around the axis V3 in the cross-section of the rolling brush assembly 300. Of course, in other embodiments, when the number of the flocking bundle groups 314 is set to be three or more, these flocking bundle groups 314 are preferably arranged at uniform intervals in the circumferential direction of the rolling brush roller 311 (i.e., in the circumferential direction of the axis V3).

The bristle bars 313 are used for contacting the surface to be cleaned when the rolling brush rotates, so as to clean the surface to be cleaned, mainly used for cleaning in a wiping mode and suitable for a floor type smooth surface to be cleaned. The bristle bars 313 are preferably in the form of a felt or pile.

The two bristle bars 313 are arranged opposite to each other in the circumferential direction of the rolling brush roller 311, and referring to FIG. 9, in the cross-section of the rolling brush assembly 300, the two bristle bars 313 are symmetrically arranged at substantially 180° around the axis V3. Of course, in other embodiments, when the number of the bristle bars 313 is set to be three or more, these hair strips 313 are preferably arranged at uniform intervals along the circumferential direction of the rolling brush roller 311 (i.e., the circumferential direction of the axis V3).

In addition, the rolling brush roller 311 has a first groove recessedly provided in its outer circumferential surface, which is preferably configured as a T-groove, extending along one longitudinal end of the rolling brush roller 311 to the other longitudinal end of the rolling brush roller 311, and symmetrically disposed with respect to the connection surface M3. Correspondingly, the inner end of the bristle bar 313 close to the axis V3 is configured to be shape-fitted with the first groove, and can be clamped in the first groove, so that the bristle bar 313 can be detachably mounted on the rolling brush roller 311, for example, the bristle bar 313 can be inserted into the first groove from one longitudinal end of the rolling brush roller 311, so that the detachable mount of the bristle bar 313 can be realized. Of course, the shape of the first groove, the manner of mounting the bristle bar 313, and the like are not limited thereto.

Furthermore, along the circumferential direction of the rolling brush roller 311, the bristle bars 313 and the flocking bundle groups 314 are alternately arranged at intervals, that is, between two adjacent flocking bundle groups 314 is provided with one bristle bar 313, and between two adjacent bristle bars 313 is provided with one flocking bundle group 314; in addition, the longitudinal extension directions of the bristle bar 313 and the flocking bundle group 314 are parallel to each other.

The tooth mechanism extends lengthwise approximately parallel to the axis V3 and includes a supporting bar 321 and a plurality of teeth 322, wherein the supporting rod 321 can be fixedly assembled on the machine body, so that the whole tooth mechanism is mounted on the machine body. These teeth 322 are arranged in sequence along the longitudinal direction of the tooth mechanism, each tooth 322 projects beyond the supporting rod 321 and extends to approach the rolling brush, and the teeth 322 can at least contact the bristle bar 313 of the bristle bar 313 and the flocking bundle group 314. In this way, the teeth 322 can contact the hairs on the bristle bar 313 to scrape off or break the hairs attached to the bristle bar 313, thereby further facilitating the hairs to be separated from the rolling brush, preventing the rolling brush from being entangled because the hairs are tightly wound on the rolling brush roller 311, and ensuring the clean surface and the normal rotation of the rolling brush.

Specifically, there is a first distance from the outer end of the bristle bars 313 facing away from the rolling brush roller 31 to the axis V3, there is a third distance from the outer end of the flocking bundle group 314 facing away from the rolling brush roller 311 to the axis V3, and there is a fourth distance from the extending ends of the teeth 322 to the axis V3, wherein the fourth distance is less than the first distance. In this way, it is ensured that the teeth 322 can contact the bristle bar 313 when the rolling brush is applied to cleaning of a surface to be cleaned, so as to scrape off or break the hairs attached to the bristle bar 313.

In the present embodiment, the third distance and the first distance are substantially equal, and the fourth distance is less than the third distance and the first distance. In this way, the extending ends of the teeth 322 can contact not only the bristle bar 313 but also further the flocking bundle group 314 to facilitate scraping off or breaking the hairs attached to tuft block 314 to further facilitate the removal of hairs from the rolling brush.

Specifically, each tooth 322 is positioned between adjacent two tufts of the flocking bundle in the longitudinal direction of rolling brush assembly 300, that is, each tooth 322 passes between adjacent two tufts of the flocking bundle, thereby pulling or breaking the hairs wound around the adjacent two tufts of flocking bundle.

To sum up, compare with the prior art, the beneficial effect of the present embodiment is: the part of the a plurality of flocking structures among the prior art is replaced with the bristle bar 313, and the flocking bundle group 314 and the bristle bar 313 are simultaneously provided, and both of them contact with the teeth 322, so as to facilitate to scrape off or break the hairs attached to the flocking bundle group 314 and the bristle bar 313, so as to further facilitate the hairs to be separated from the rolling brush, so that the rolling brush is prevented from being entangled because the hairs are tightly wound on the rolling brush roller 311, and the surface clean and the normal rotation of the rolling brush are ensured.

Embodiment 4

Figure 10:
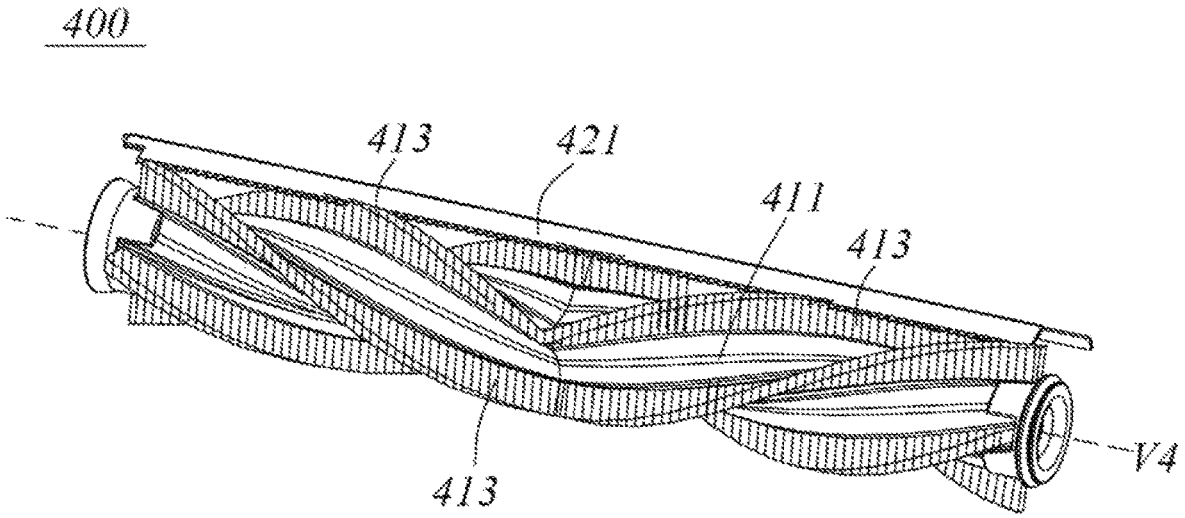
FIG. 10 is a schematic isometric view of a rolling brush assembly according to Embodiment 4 of the present disclosure.
Figure 11:
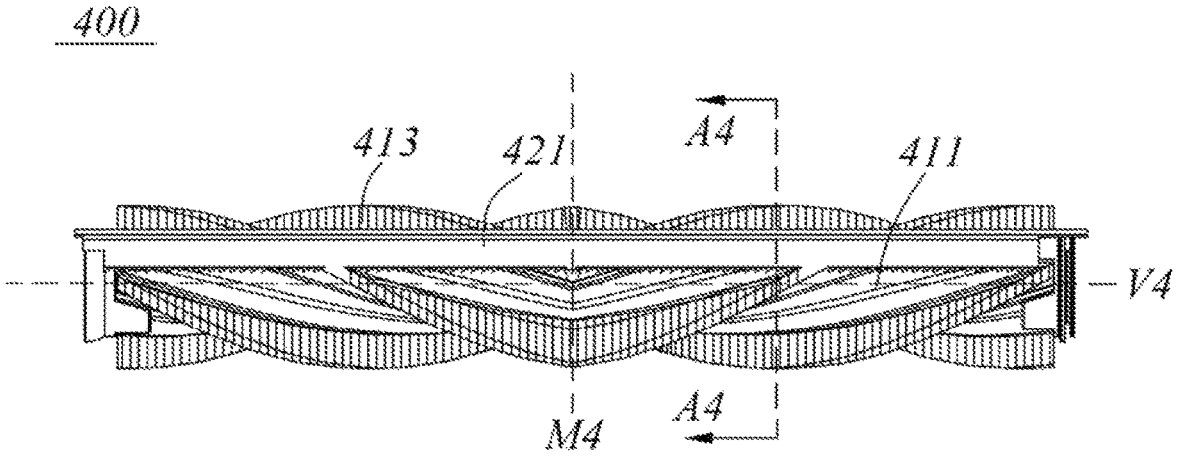
FIG. 11 is a front view of the rolling brush assembly according to Embodiment 4 of the present disclosure.
Figure 12:
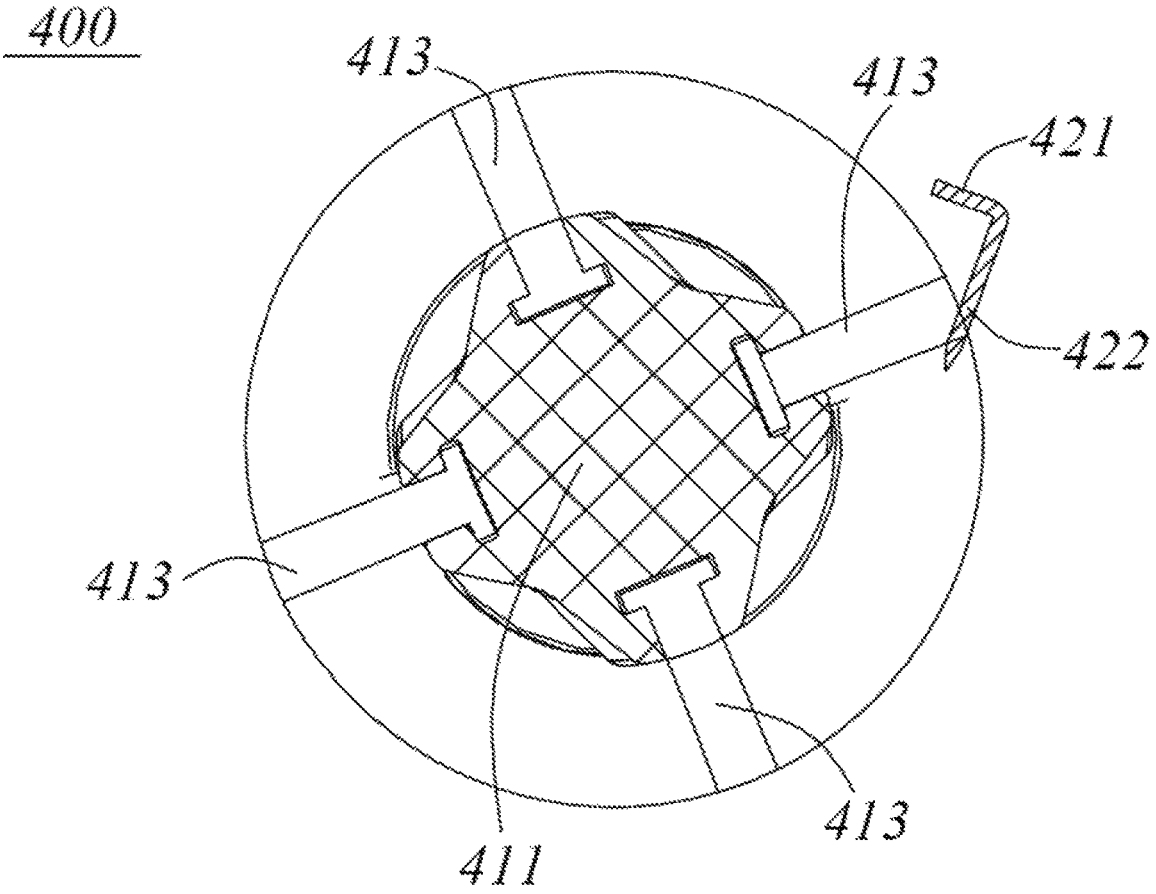
FIG. 12 is a cross-sectional view taken along line A4-A4 of FIG. 11.

Unlike Embodiment 3, in Embodiment 4, referring to FIGS. 10-12 in particular, all of the flocking structure in the prior art can be replaced by at least three bristle bars 413, which not only enhances the cleaning effect, but also the bristle bars 413 contact with the teeth 422 to scrape off or break the hairs attached to the bristle bars 413, so as to further facilitate the hairs to be separated from the rolling brush, prevent the rolling brush from being entangled due to the hair tightly wound on the rolling brush 411, and ensure the surface clean and the normal rotation of the rolling brush. The method comprises the following specific steps:

in the present embodiment, the rolling brush extends lengthwise along an axis V4, and includes a rolling brush roller 411 and brush bars 413 mounted on the rolling brush roller 411. The number of the brush bars 413 is set to be at least three, and these brush bars 413 are arranged at uniform intervals along the circumferential direction of the rolling brush roller 411 (i.e., the circumferential direction of the axis V4). In the present embodiment, the number of the brush bars 413 is set to be four, and the four brush bars 413 are arranged at uniform intervals in the circumferential direction of the rolling brush roller 411, and referring to FIG. 12, in the cross-section of the rolling brush assembly 300, the four brush bars 413 are distributed at substantially 90° intervals around the axis V4.

As mentioned above, in the present embodiment, the four brush bars 413 are provided to be identical, and are provided as bristle bars whose bristle is preferably a felt or fluff shape, and are suitable for a floor type smooth surface to be cleaned, and can wipe the surface to be cleaned.

Furthermore, in the present embodiment, there is a first distance from the outer end of the brush bar 413 facing away from the rolling brush roller 411 to the axis V4 and there is a fourth distance from the extending ends of the teeth 422 to the axis V4, where the fourth distance is less than the first distance, i.e. the extending ends of the teeth 422 are closer to the axis V4 than the outer end of the brush bar 413. In this way, it is ensured that the teeth 422 can contact the brush bars 413 when the rolling brush is applied to the cleaning of the surface to be cleaned, so as to scrape off or break the hairs attached to the brush bars 413.

Embodiment 5

Figure 13:
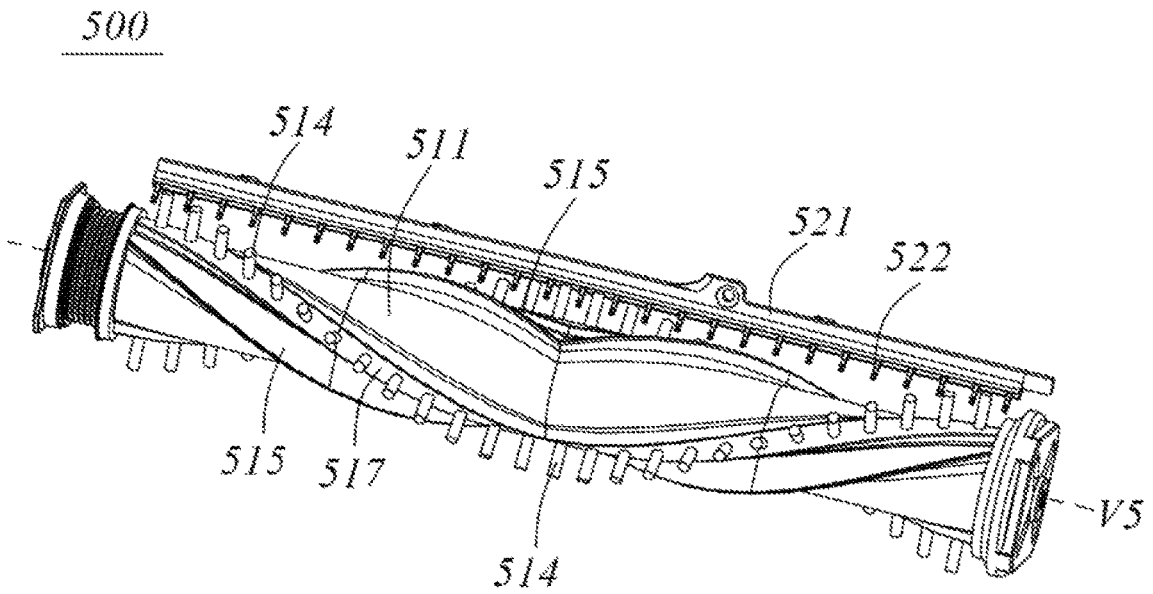
FIG. 13 is a schematic isometric view of a rolling brush assembly according to Embodiment 5 of the present disclosure.
Figure 14:
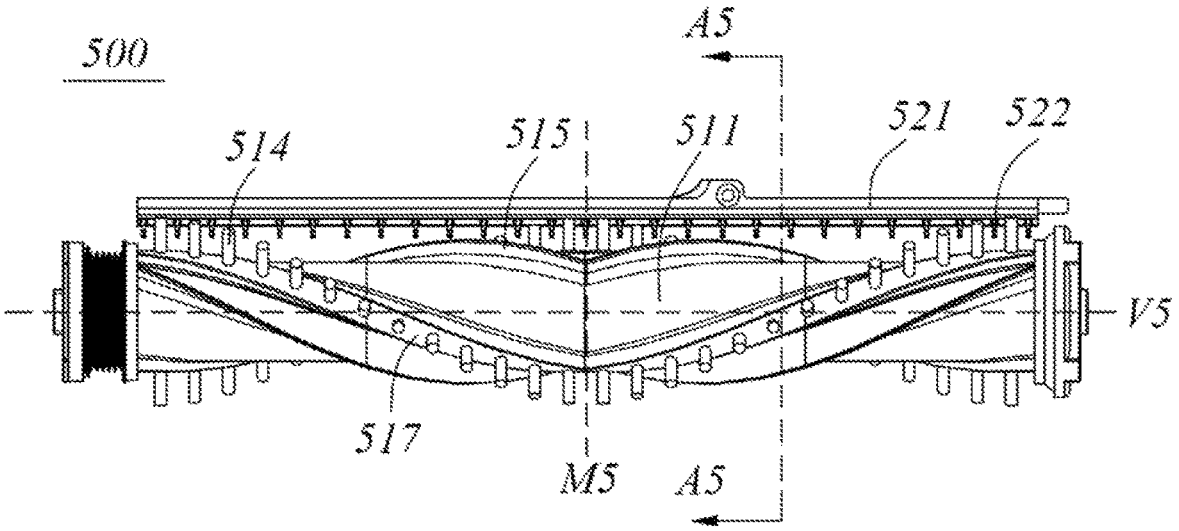
FIG. 14 is a front view of the rolling brush assembly in Embodiment 5 of the present disclosure.
Figure 15:
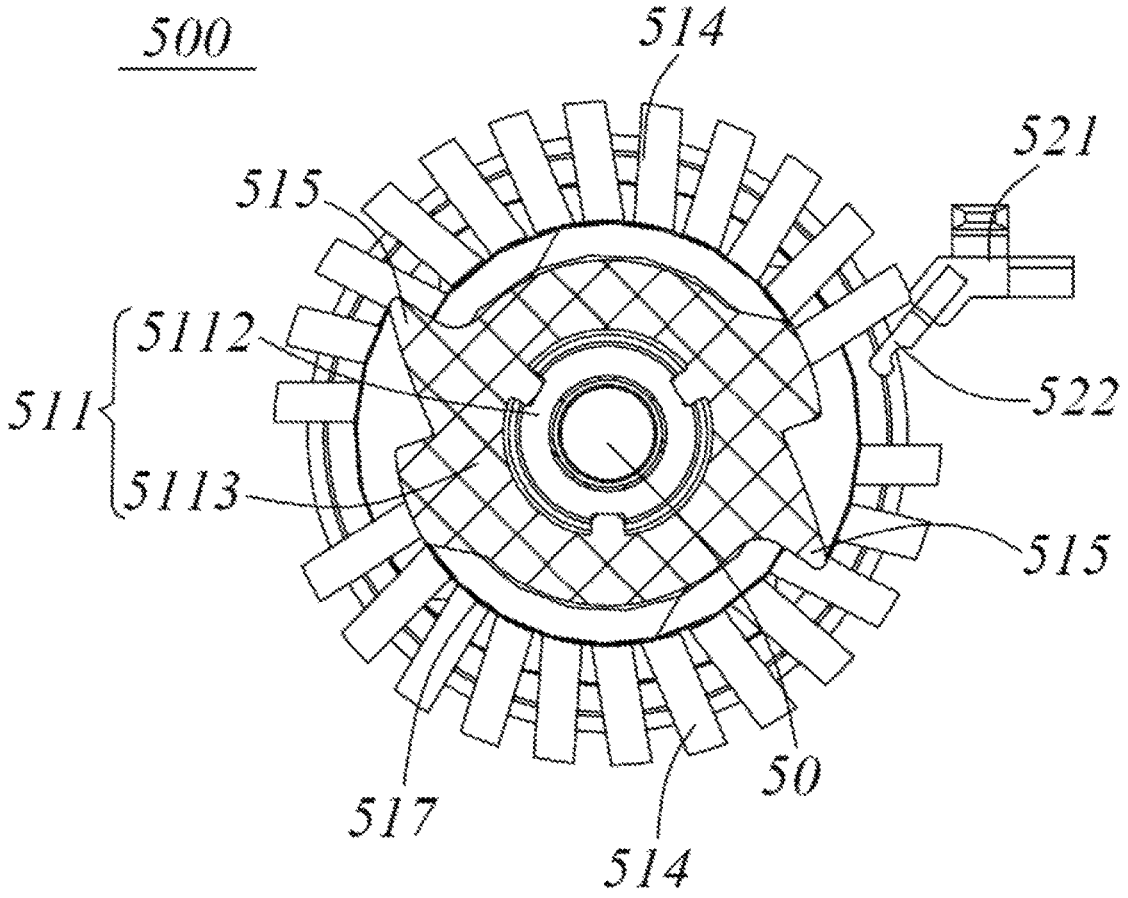
FIG. 15 is a cross-sectional view taken along line A5-A5 of FIG. 14.

Referring to FIGS. 13 to 15, a rolling brush assembly 500 according to Embodiment 5 of the present disclosure will be described. A rolling brush assembly 500 is provided lengthwise and includes a rolling brush and a tooth mechanism matched with the rolling brush.

The rolling brush extends lengthwise along an axis V5, and includes a rolling brush roller 511, a protruding strip 515 protruding on the outer circumferential surface of the rolling brush roller 511, and brush bars 514 mounted on the rolling brush roller 511, wherein the brush bars 514 are fixed on the rolling brush roller 511 in a flocking or inserting manner, and an engagement portion 517 is formed between the brush bars 514 and the rolling brush roller 511. The engagement portion 517 forms a supporting fixation for the brush bars 514. The distance from the outer end of the engagement portion 517 to the axis V5 is less than the distance from the outer end of the protruding strip 515 to the axis V5, which is facilitate for the protruding strip 515 to radially expand the filaments in the rolling brush roller 511, and prevents the filaments from tightly winding on the rolling brush roller 511. Common filaments include hair, body hair, animal hair, etc., and it should be noted that filaments are not limited to the above examples.

The rolling brush roller 511 is substantially a longitudinal cylinder with the axis V5 as the central axis, is rotatably connected to the machine body, and is driven by the motor to rotate around the axis V5, so as to drive the rolling brush to rotate integrally. Specifically, the rolling brush roller 511 specifically includes an inner roller 5112 sleeved outside the central rotating shaft 50 and an outer roller 5113 fixedly wrapped outside the inner roller 5112. The central rotating shaft 50 is connected with the driving shaft of the motor; the inner roller 5112 is generally configured as a rigid member, and is used for supporting the outer roller 5113 so as to avoid the great bending deformation of the outer roller 5113 under the action of an external force, thereby ensuring the stable configuration of the rolling brush; the outer circumferential surface of the outer roller 5113 constitutes the outer circumferential surface of the rolling brush roller 511, and the outer roller 5113 is used to fixedly assembly the brush bars 514.

Preferably, as shown in FIG. 14, the rolling brush roller 511 is formed by two equal length segments in the longitudinal direction thereof, and the two segments of the rolling brush roller 511 are arranged to be centrally symmetric with respect to the connecting plane M5. The rolling brush roller 511 is integrally formed, or the two segments of the rolling brush rollers 511 are independently formed, assembled and spliced.

The brush bars 514 are used for contacting the surface to be cleaned when the rolling brush rotates, so as to clean the surface to be cleaned, the number of the brush bars is set to be at least two, and these brush bars 514 are arranged at uniform intervals along the circumferential direction of the rolling brush 511 (i.e., the circumferential direction of the axis V5). In the present embodiment, the number of the brush bars 514 is set to be two, and the two brush bars 514 are oppositely arranged in the circumferential direction of the rolling brush roller 511, and referring to FIG. 14, in the cross-section of the rolling brush assembly 500, two flocking bundle groups are symmetrically arranged at substantially 180° around the axis V5.

Each brush bar 514 extends lengthwise in the longitudinal direction of the rolling brush roller 511, and the longitudinal direction thereof may be parallel to the axis V5 or may extend curvedly as illustrated in the drawings, and one longitudinal end thereof is disposed at one longitudinal end of the rolling brush roller 511 and the other longitudinal end thereof is disposed at the other longitudinal end of the rolling brush roller 511, that is, the brush bar 514 extends from one longitudinal end of the rolling brush roller 511 to the other longitudinal end.

In the present embodiment, as shown in FIG. 14, each brush bar 514 includes a first segment extending in a first spiral direction and a second segment extending in a second spiral direction on the outer circumferential surface of the brush roller 511, the first spiral direction and the second spiral direction being opposite; the first segment of the brush bar 514 and the second segment of the brush bar 514 intersect at the connecting plane M5, i.e., each brush bar 514 is distributed in a V-shape on the outer circumference of the rolling brush roller 511. It is further preferred that the first segment of the brush bar 514 and the second segment of the brush bar 514 are arranged to be centrally symmetric with respect to the connecting plane M5. Of course, in a modified embodiment, each brush bar 514 may extend in a single helical direction about the axis V5.

Furthermore, the brush bar 514 is a flocking bundle group flocked on the rolling brush roller 511, and the flocking bundle group is used for contacting the surface to be cleaned when the rolling brush rotates, so as to clean the surface to be cleaned, mainly for cleaning dust, and is more suitable for the surface to be cleaned of carpet. The flocking bundle group is formed by a plurality of tufts of flocking bundle. Each tuft of flocking bundle extends from the rolling brush roller 511 away from axis V5, the plurality of tufts of flocking bundle being spaced apart in sequence along the flocking bundle group to form an elongated structure. Moreover, the two different tufts of flocking bundles can be set into straight bristles or curved bristles, or one of the two tufts of flocking bundles is set into straight bristle and the other is set into curved bristle. Preferably, in one of the flocking bundle group, a tuft of straight bristles and a tuft of curved bristles are arranged alternately. In addition, the flocking bundle may be made of synthetic fibers in terms of material, but is not limited thereto. Moreover, in a modified embodiment, the brush bar 514 may also be configured that the flocking bundle is in other form, for example, the flocking is provided as a bristle bar and comprises bristles in the form of felt or floss, so as to be suitable for smooth surfaces to be cleaned, such as floors; for another example, a part of the at least two brush bars 514 are provided as bristle bars and comprise bristles in the form of felt or pile, while another part is provided as a flocking bundle group.

The protruding strips 515 are arranged between two adjacent flocking bundle groups and are integrally formed with the rolling brush roller 511, specifically, the protruding strips 515 are integrally provided and protrude beyond the outer circumferential surface of the outer roller 5113, and through providing the protruding strips 515, as previously mentioned, the distance from the outer ends of the protruding strips 515 to the axis V5 is greater than the distance from the outer end of the engagement portion 517 to the axis V5, so as to facilitate the protruding strips 515 to radially expand filaments on the rolling brush roller 511, so that the hairs are suspended due to the support of the two protruding strips 515, thereby facilitating the hairs to be separated from the rolling brush, avoiding the rolling brush being entangled because the hairs are tightly wound on the rolling brush roller 511, and ensuring the surface clean and the normal rotation of the rolling brush.

In the present embodiment, there is a first distance from the outer end of the flocking bundle group facing away from the rolling brush roller 511 to the axis V5, and there is a second distance from the outer end of the protruding strip 515 facing away from the rolling brush roller 511 to the axis V5, wherein the second distance is less than the first distance, that is, the outer end of the protruding strip 515 is closer to the axis V5 than the outer end of the flocking bundle group. In this way, when the rolling brush is applied to the cleaning of the surface to be cleaned, it is not only conducive to improving the cleaning effect, but also conducive to separating the hairs from the rolling brush under the supporting of the protruding strips 515, thereby avoiding the rolling brush being entangled because the hairs are tightly wound on the rolling brush roller 511, and ensuring the surface clean and the normal rotation of the rolling brush.

Preferably, between any two adjacent flocking bundle groups is provided with a protruding strip 515, and these protruding strips 515 are uniformly spaced along the circumferential direction of the rolling brush roller 511. In the present embodiment, the number of the protruding strips 515 is set to be two, and the two protruding strips 515 are arranged opposite to each other in the circumferential direction of the rolling brush 511, and referring to FIG. 14, in the cross-section of the rolling brush assembly 500, the two protruding strips 515 are arranged at substantially 180° symmetrically about the axis V5.

The protruding strips 515 and the flocking bundle groups are alternately arranged at intervals along the circumferential direction of the rolling brush roller 511, that is, between two adjacent flocking bundle groups is provided with one protruding strip 515, and between two adjacent protruding strips 515 is provided with one flocking bundle group.

Each protruding strip 515 extends lengthwise in the longitudinal direction of the rolling brush roller 511, the longitudinal extension direction of which may be parallel to the axis V5 or extends curvedly as illustrated in the drawing, one longitudinal end thereof is disposed at one longitudinal end of the outer roller 5113 and the other longitudinal end thereof is disposed at the other longitudinal end of the outer roller 5113, that is, each protruding strip 515 extends from one longitudinal end of the outer roller 5113 to the other longitudinal end.

As shown in FIG. 14, each of the protruding strips 515 includes a first segment extending in a first spiral direction and a second segment extending in a second spiral direction on the outer circumferential surface of the rolling brush roller 511, the first spiral direction and the second spiral direction being opposite to each other; the first segment of the protruding strip 515 and the second segment of the protruding strip 515 intersect at the connecting plane M5, that is, each rib 515 is arranged in a V-shape on the outer circumference of the rolling brush roller 511. Further preferably, the first segment of the protruding strip 515 and the second segment of the protruding strip 515 are arranged to be centrally symmetric with respect to the connection plane M5. Of course, in a modified embodiment, each protruding strip 515 may extend in a single spiral direction about axis V5.

Furthermore, the longitudinal extension directions of the protruding bar 515 and the flocking bundle group are parallel to each other.

The tooth mechanism extends lengthwise approximately parallel to the axis V5 and includes a supporting rod 521 and a plurality of teeth 522, wherein the supporting rod 521 can be fixedly assembled on the machine body, so that the tooth mechanism is mounted on the machine body integrally. These teeth 522 are arranged in sequence along the longitudinal direction of the tooth mechanism, each tooth 522 protrudes beyond the supporting rod 521 and extends to approach the rolling brush, and the teeth 522 can be contacted with the flocking bundle group but not with the protruding strips 515. That is, there is a fourth distance from the extension ends of the teeth 522 to the axis V5, wherein the fourth distance is less than the first distance and greater than the second distance. In this way, the teeth 522 can insert inside the flocking bundle group, thereby scraping off or breaking the hairs on the flocking bundle group, so as to further facilitate the removal of the hairs from the rolling brush, avoids the rolling brush being entangled and because the hairs are tightly wound on the rolling brush roller 511, and the teeth 52 will not collide or intervene with the protruding strips 515, ensuring the surface clean and the normal rotation of the rolling brush.

Furthermore, each tooth 522 is positioned between adjacent two tufts of the flocking bundle in the longitudinal direction of the brush roller assembly 500, that is, each tooth 522 passes between adjacent two tufts of the flocking bundle, thereby pulling or breaking the hairs wound in the adjacent two tufts of the flocking bundle.

To sum up, compared with the prior art, the beneficial effect of the present embodiment is: the protruding strips 515 are integrally formed on the outer circumferential surface of the rolling brush roller 511, so that the hairs are supported by the protruding strips 515, the rolling brush is prevented from being entangled because the hairs are tightly wound on the rolling brush roller 511, and the surface clean and the normal rotation of the rolling brush are ensured; in addition, the teeth 522 can be inserted into the flocking bundle group, so as to scrape off or break the hairs attached to the flocking bundle group, and further facilitate the hairs to be separated from the rolling brush, thereby avoiding the rolling brush being entangled because the hairs are tightly wound on the rolling brush roller 511, moreover, the teeth will not collide and intervene with the protruding strips 515, and the surface clean and the normal rotation of the rolling brush are ensured.

Embodiment 6

Figure 16:
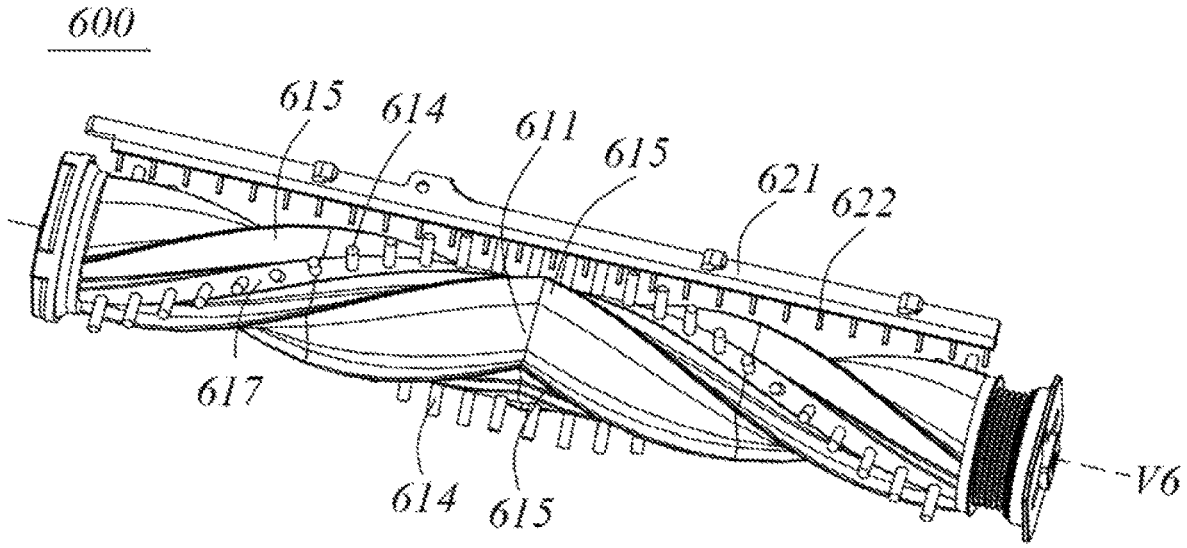
FIG. 16 is a schematic isometric view of a rolling brush assembly according to Embodiment 6 of the present disclosure.
Figure 17:
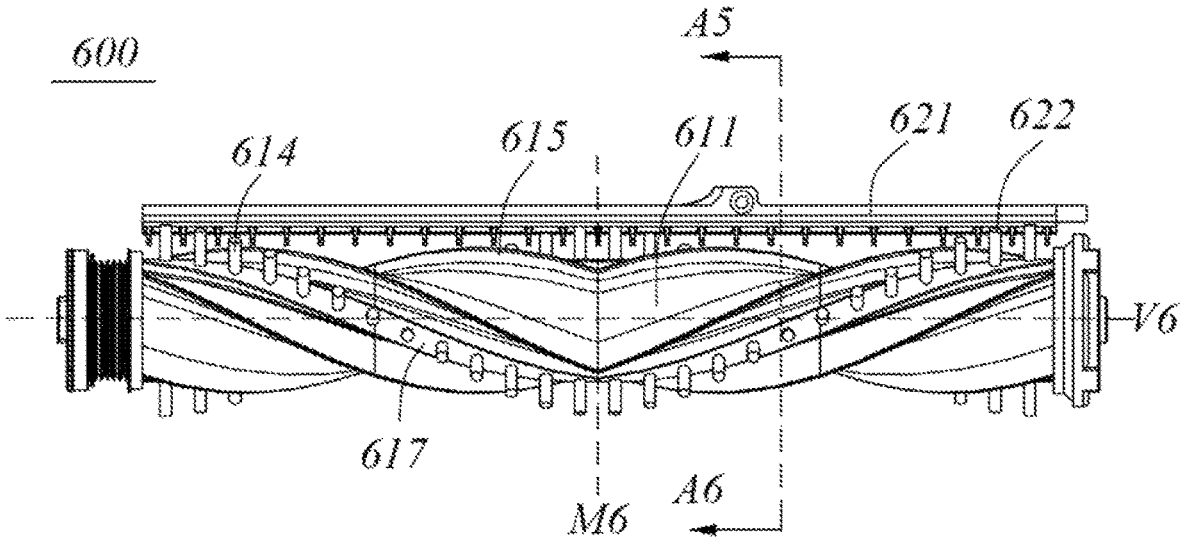
FIG. 17 is a front view of the rolling brush unit according to Embodiment 6 of the present disclosure.
Figure 18:
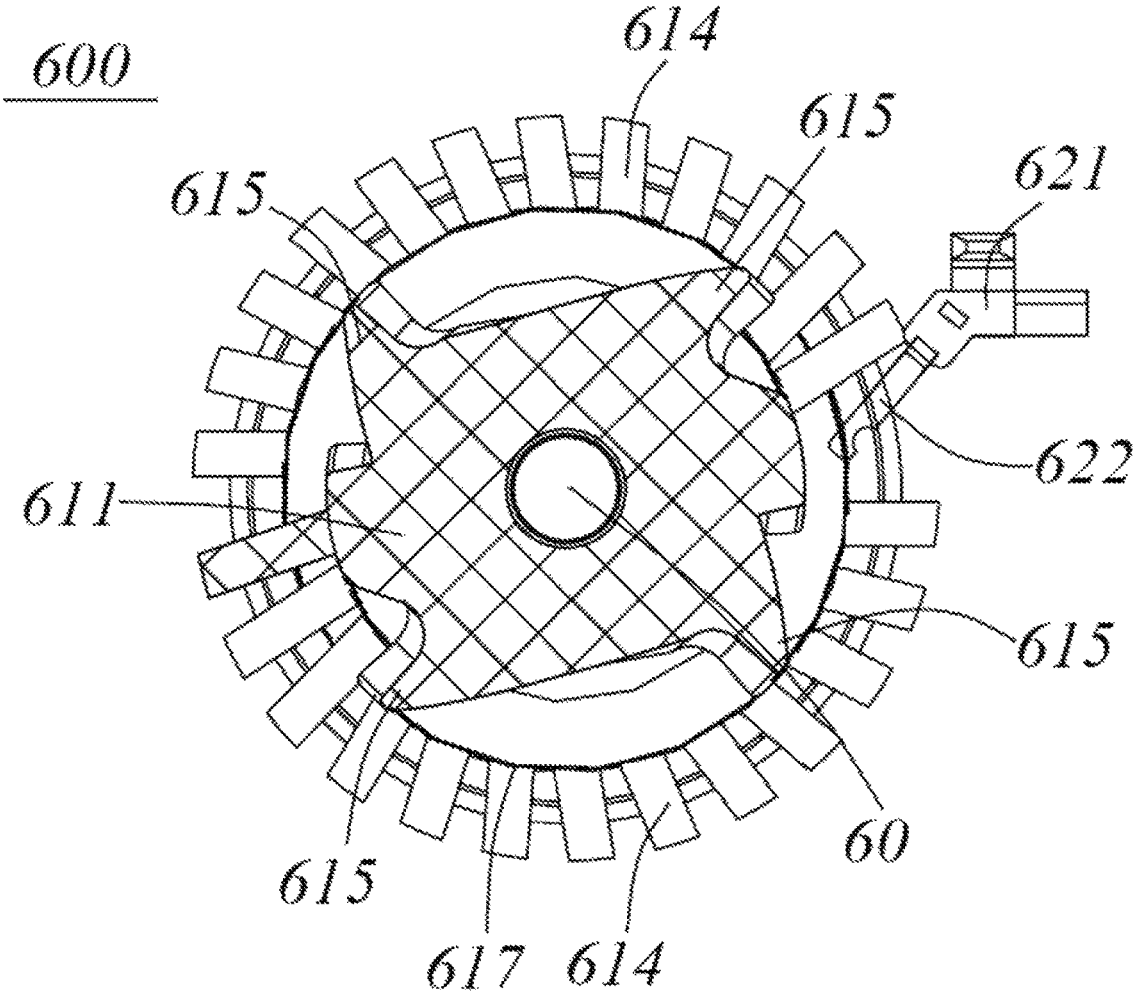
FIG. 18 is a cross-sectional view taken along line A6-A6 of FIG. 17.

Referring to FIGS. 16 to 18, a rolling brush assembly 600 according to Embodiment 6 of the present disclosure will be described. The rolling brush assembly 600 of the present Embodiment 6 has only the following differences compared to the rolling brush assembly 500 of the Embodiment 5: the number of protruding strips 615. Only this difference will be described below, and the other parts that are the same as those of Embodiment 5 will not be described again.

Unlike the Embodiment 5 in which between two adjacent brush bars 514 is provided with one protruding strip 515, in the Embodiment 6, between any two adjacent brush bars 614 is provided with two protruding strips 615. Specifically, as illustrated in the drawing, the number of the brush bars 614 is two, and the number of the protruding strips 615 is set to be four.

And furthermore, between the adjacent two brush bars 614, the two protruding strips 615 are arranged at intervals along the circumferential direction of the rolling brush roller 611 (i.e., the circumferential direction of the axis V6), and are respectively close to the two brush bars 514, that is, one protruding strip 615 is close to one of the adjacent two brush bars 614, and the other protruding strip 615 is close to the other one of the adjacent two brush bars 614. In this way, in addition to the beneficial effects of Embodiment 5, the present embodiment further enhances the supporting effect of the protruding strips 615 to the hairs, and facilitates the hairs to be separated from the rolling brush, so as to avoid the hair from being entangled on the rolling brush roller 611.

It should be understood that although the specification describes embodiments, not every embodiment includes only a single embodiment, and such description is for clarity purposes only, and it will be appreciated by those skilled in the art that the specification as a whole may be appropriately combined to form other embodiments as will be apparent to those skilled in the art.

A series of detailed descriptions listed above are only specific descriptions of the feasible embodiments of the present disclosure, they are not used to limit the scope of protection of the present disclosure, and any equivalent embodiments or modifications made without departing from the technical spirit of the present disclosure shall be included in the scope of protection of the present disclosure.

The invention claimed is:

1. A rolling brush assembly, comprising:

a rolling brush having a rolling brush roller, at least two brush bars, and a protruding strip extending lengthwise along an axis, each of the brush bars extending lengthwise in a longitudinal direction of the rolling brush roller, the at least two brush bars being arranged at intervals along a circumferential direction of the rolling brush roller, the protruding strip being located between adjacent two brush bars;

wherein the at least two brush bars are fixed on the rolling brush roller in one of a flocking or an inserting manner, an engagement portion being formed between the brush bars and the rolling brush roller, a distance from an outer end of the engagement portion to the axis being less than a distance from an outer end of the protruding strip to the axis; and wherein a tooth mechanism including a supporting rod extends lengthwise parallel to the axis and a plurality of teeth extend from the supporting rod towards the rolling brush, a distance from extending ends of the teeth to the axis being less than a distance from an outer end of the brush bar to the axis.

2. The rolling brush assembly of claim 1, wherein the distance from the extending ends of the teeth to the axis is greater than the distance from the outer end of the protruding strip to the axis.

3. The rolling brush assembly of claim 1, wherein the brush bar is configured as a bristle bar and includes bristles in the form of felt or pile, or the brush bar is configured as a flocking bundle group.

4. The rolling brush assembly of claim 1, wherein a part of the at least two brush bars is configured as a bristle bar and includes bristles in the form of felt or pile, and another part of the at least two brush bars is provided as a flocking bundle group.

5. The rolling brush assembly of claim 4, wherein each of the at least two brush bars and each of the protruding strips extend from one longitudinal end of the rolling brush roller to another longitudinal end of the rolling brush roller; wherein one of:

each of the at least two brush bars includes two segments respectively extending in opposite spiral directions on an outer circumferential surface of the rolling brush roller and each of the protruding strips includes two segments respectively extending in opposite spiral directions on the outer circumferential surface of the rolling brush roller; or each of the at least two brush bars and each of the protruding strips extends in a single spiral direction about the axis.

6. A dust collector having a machine body and a motor mounted on the machine body, the dust collector comprising:

a rolling brush assembly including a rolling brush mounted in the machine body and driven by the motor to rotate about an axis, the rolling brush including a rolling brush roller, brush bars, and protruding strips extending lengthwise along the axis, the brush bars and the protruding strips extending lengthwise in a longitudinal direction of the rolling brush roller;

wherein the brush bars are fixed on the rolling brush roller in a flocking or an inserting manner, the brush bars and the rolling brush roller form an engagement portion therebetween, and a distance from an outer end of the engagement portion to the axis is less than a distance from outer ends of the protruding strips to the axis; and wherein a tooth mechanism including a supporting rod extends lengthwise parallel to the axis and a plurality of teeth extend from the supporting rod towards the brush roller, a distance from extending ends of the teeth to the axis being less than a distance from outer ends of the brush bars to the axis.

7. The dust collector of claim 6, wherein the distance from the extending ends of the teeth to the axis is greater than a distance from outer ends of the protruding strips to the axis.

8. The dust collector of claim 7, wherein the brush bar is configured as a bristle bar and includes bristles in the form of felt or pile, or the brush bar is configured as a flocking bundle group.

* * * * *